US012064077B2

(12) United States Patent
Lee et al.

(10) Patent No.: US 12,064,077 B2
(45) Date of Patent: Aug. 20, 2024

(54) CLEANER

(71) Applicant: LG Electronics Inc., Seoul (KR)

(72) Inventors: Dongjae Lee, Seoul (KR); Hwayeong Kang, Seoul (KR); Jinho Kim, Seoul (KR); Donggeun Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 16/509,866

(22) Filed: Jul. 12, 2019

(65) Prior Publication Data

US 2020/0015644 A1 Jan. 16, 2020

(30) Foreign Application Priority Data

Jul. 12, 2018 (KR) ..... 10-2018-0081012

(51) Int. Cl.
*A47L 9/04* (2006.01)
*A47L 11/40* (2006.01)

(52) U.S. Cl.
CPC ..... *A47L 9/0472* (2013.01); *A47L 9/0411* (2013.01); *A47L 11/4083* (2013.01); *A47L 11/4088* (2013.01)

(58) Field of Classification Search
CPC ..... A47L 9/0472; A47L 11/4083; A47L 11/4088; A47L 11/4038
See application file for complete search history.

(56) References Cited

U.S. PATENT DOCUMENTS 6,109,811 A 8/2000 Song
6,792,648 B2 * 9/2004 Lee ..... A47L 9/0411 15/377
7,013,527 B2 3/2006 Thomas, Sr. et al.
(Continued)

FOREIGN PATENT DOCUMENTS

CN 1894453 A 1/2007
CN 101664293 A 3/2010
(Continued)

OTHER PUBLICATIONS

Translation of KR101595727 B1 (Year: 2022).*
(Continued)

*Primary Examiner* — Brian D Keller
*Assistant Examiner* — Sarah Akyaa Fordjour
(74) *Attorney, Agent, or Firm* — Birch, Stewart, Kolasch & Birch, LLP

(57) ABSTRACT

A nozzle for a cleaner may comprise a nozzle housing and a rotation cleaning unit rotatably disposed under the nozzle housing. The rotation cleaning unit may comprise a mop configured to clean a floor and a rotation plate coupled to the mop. The nozzle may comprise a driving device disposed in the nozzle housing and comprising a motor configured to drive the rotation cleaning unit, and a water tank mounted on the nozzle housing and configured to store water. The mop may comprise a floor cleaning portion, an attaching portion disposed above the floor cleaning portion to be coupled to the rotation plate, and an upper absorbing portion disposed above the floor cleaning portion and at least partially overlapping the attaching portion. The upper absorbing portion may be sewn to the attaching portion and may be configured to absorb water from the water tank.

30 Claims, 25 Drawing Sheets

(56) References Cited

U.S. PATENT DOCUMENTS

| | | | | |
|---|---|---|---|---|
| 7,836,544 | B2 | 11/2010 | Jansen | |
| 8,060,973 | B2 * | 11/2011 | Wildeman | D04H 11/00 15/228 |
| 8,597,758 | B2 | 12/2013 | Kaminer et al. | |
| 10,595,698 | B2 * | 3/2020 | Williams | A47L 11/4036 |
| 10,820,764 | B2 | 11/2020 | Krebs | |
| 2007/0141299 | A1 | 6/2007 | Hong | |
| 2015/0128369 | A1 | 5/2015 | Zorzo | |
| 2015/0182090 | A1 * | 7/2015 | Park | A47L 11/4063 15/98 |
| 2017/0273522 | A1 | 9/2017 | Krebs | |
| 2018/0192846 | A1 | 7/2018 | Ji et al. | |
| 2019/0246865 | A1 | 8/2019 | Ribbe et al. | |
| 2019/0313867 | A1 | 10/2019 | Shin et al. | |

FOREIGN PATENT DOCUMENTS

| | | | | |
|---|---|---|---|---|
| CN | 102774054 | A | 11/2012 | |
| CN | 202960398 | U | 6/2013 | |
| CN | 203226786 | U | 10/2013 | |
| CN | 203226787 | U | 10/2013 | |
| CN | 203815401 | U | 9/2014 | |
| CN | 104334069 | A | 2/2015 | |
| CN | 205058757 | U | 3/2016 | |
| CN | 105769075 | A | 7/2016 | |
| CN | 107518828 | A | 12/2017 | |
| DE | 20 2018 101 995 | U1 | 5/2018 | |
| EP | 0361505 | A2 | 4/1990 | |
| EP | 2 449 937 | A2 | 5/2012 | |
| JP | 52-96964 | U | 7/1977 | |
| JP | 2007-503258 | A | 2/2007 | |
| KR | 2001-0093648 | A | 10/2001 | |
| KR | 10-2002-0048308 | A | 6/2002 | |
| KR | 10-0400515 | B1 | 10/2003 | |
| KR | 10-0405244 | | 11/2003 | |
| KR | 10-2004-0015189 | A | 2/2004 | |
| KR | 100688615 | B1 * | 3/2007 | |
| KR | 10-2007-0059300 | A | 6/2007 | |
| KR | 10-2008-0036400 | A | 4/2008 | |
| KR | 10-2008-0106745 | A | 12/2008 | |
| KR | 10-2010-0028951 | A | 3/2010 | |
| KR | 10-2012-0035307 | A | 4/2012 | |
| KR | 101595727 | B1 * | 2/2016 | |
| KR | 101654015 | B1 * | 9/2016 | |
| KR | 10-1672203 | B1 | 11/2016 | |
| KR | 20170043227 | A * | 4/2017 | |
| TW | 200800089 | A | 1/2008 | |
| TW | 201707640 | A | 3/2017 | |
| TW | 201729741 | A | 9/2017 | |
| TW | 201740857 | A | 12/2017 | |
| TW | M553174 | U | 12/2017 | |
| TW | I615118 | B | 2/2018 | |
| WO | WO 2011/005027 | | 1/2011 | |
| WO | WO-2011005027 | A2 * | 1/2011 | A47L 11/16 |
| WO | WO 2018/117763 | A1 | 6/2018 | |

OTHER PUBLICATIONS

Translation of WO-2011005027-A2 (Year: 2022).*
Translation of KR101654015B1 (Year: 2022).*
Translation of KR100688615B1 (Year: 2023).*
Translation of KR-20170043227-A (Year: 2024).*
Korean Office Action received in corresponding Korean Patent Application No. 10-2020-0003100, dated Jan. 9, 2020 (7 pages).
Korean Notice of Allowance received in Korean Patent Application No. 10-2020-0003100, dated Aug. 19, 2020 (2 pages).
International Search Report from the Korean Intellectual Property Office (KIPO) in PCT/KR2019/007389, dated Sep. 24, 2019.
Taiwanese Office Action received in Taiwanese Patent Application No. 110101845, dated May 28, 2019 (4 pages).
Taiwanese Search Report received in Taiwanese Patent Application No. 110101845, dated May 28, 2021 (1 page).

* cited by examiner

CLEANER

CROSS-REFERENCE TO RELATED APPLICATIONS

The present application claims priority under 35 U.S.C. 119 to Korean Patent Application No. 10-2018-0081012, filed on Jul. 12, 2018, the disclosure of which is hereby incorporated by reference in its entirety.

TECHNICAL FIELD

The present disclosure relates to a nozzle for a cleaner.

BACKGROUND

A cleaner may comprise a device configured to suction or wipe dust or foreign matter from a region to be cleaned to perform a cleaning.

Such a cleaner can be classified into a manual cleaner for performing cleaning while a user directly moves the cleaner and an automatic cleaner for performing cleaning while the cleaner travels by itself.

The manual cleaner can be classified into a canister-type cleaner, an upright-type cleaner, a handy-type cleaner, and a stick-type cleaner, based on the type of the cleaner.

These cleaners can clean a floor using nozzles. In general, nozzles can be used so as to suction air and dust. According to the type of the nozzle, the nozzle may be attached with a mop to clean the floor with the mop.

Korean Patent Registration No. 10-0405244, which is related art 1, discloses a suction port assembly for a vacuum cleaner.

The suction port assembly of the related art 1 includes a suction port main body provided with a suction port.

The suction port main body includes a first suction path in the front, a second suction path in the rear, and a guide path formed between the first suction path and the second suction path.

A mop is rotatably installed on the lower end of the suction port main body, and a rotation driving unit for driving the mop is provided in the suction port main body.

The rotation driving unit includes one rotation motor and gears for transmitting the power of one rotation motor to a plurality of rotating bodies, to which the mops are attached.

Meanwhile, according to the related art 1, since a pair of rotating bodies disposed on both sides of the rotation driving unit is rotated using one rotating motor, if the rotating motor fails or malfunctions, there is a problem that all of the pair of rotating bodies cannot be rotated.

In order to rotate the pair of rotating bodies using one rotation motor, since the rotation motor is positioned at the center of the suction port main body, it is necessary to design a suction path for preventing interference with the rotation motor. Thus, there are disadvantages that the length of the suction path is lengthened and the structure for forming a suction path is complicated.

Since the related art 1 does not have a structure for supplying water to a mop, in a case where cleaning may be desired to be performed using a mop with water, there is a disadvantage that a user has to directly supply water to the mop.

On the other hand, Korean Patent Laid-Open Publication No. 10-2017-0028765, which is the related art 2, discloses a cleaner.

The cleaner disclosed in the related art 2 includes a cleaner main body, to which a mop is rotatably installed on a lower portion thereof, a water bottle which is mounted to a handle which is connected to the cleaner main body or the cleaner main body, a water spray nozzle which is installed so as to spray water to the front of the cleaner main body, and a water supply unit for supplying the water in the water tank to the water spray nozzle.

In a case of the related art 2, since the water spray nozzle is sprayed forward from a front surface of the cleaner main body, there is a possibility that the sprayed water may wet other nearby structures instead of a mop.

The water spray nozzle is disposed at the center of the cleaner main body, while the mop is arranged in the lateral direction. As such, there is a problem that the mop cannot sufficiently absorb the water sprayed forward of the cleaner main body.

In a case of the related art 2, since there is no flow path for suctioning air, there is a disadvantage that only the floor can be wiped, and foreign matters present on the floor have to be manually cleaned again by the user.

SUMMARY

The present disclosure provides a nozzle for a cleaner that can increase the amount of water in a mop.

The present disclosure provides a nozzle for a cleaner that can reduce friction between a floor and a floor cleaning portion using a mop.

The present disclosure provides a nozzle for a cleaner that can easily align the center of a mop and a rotation plate when the mop is mounted on the rotation plate.

A nozzle for a cleaner according to an embodiment of the present disclosure comprises a nozzle housing and a rotation cleaning unit rotatably disposed under the nozzle housing. The rotation cleaning unit comprises a mop configured to clean a floor and a rotation plate coupled to the mop. The nozzle also comprises a driving device disposed in the nozzle housing and having a motor configured to drive the rotation cleaning unit.

The nozzle for a cleaner may further comprise a water tank mounted on the nozzle housing and configured to store water to be supplied to the rotation cleaning unit.

The mop may comprises a floor cleaning portion and an attaching portion disposed above the floor cleaning portion and configured to be attached to the rotation plate.

The mop may further include an upper absorbing portion disposed above the floor cleaning portion and at least partially overlapping the attaching portion. The upper absorbing portion may be attached to the attaching portion and may be configured to absorb water supplied from the water tank.

The mop may further include a center opening formed through a center of the floor cleaning portion and a center of the upper absorbing portion.

The mop may further comprise a guide rib guiding attachment disposed on the rotation plate, and when the mop is attached to the rotation plate, the guide rib may be positioned at the center opening.

The nozzle may further comprise a plurality of sewing lines disposed on the mop, and the plurality of sewing lines may cross each other in cross shapes. Crossing centers of the plurality of sewing lines may be positioned at the center portion of the mop. The center portion of the mop may comprise a predetermined area including the center of the mop and having a predetermined radius from the center.

The attaching portion may be ring-shaped, and an outer diameter of the upper absorbing portion may be larger than an inner diameter of the attaching portion.

A portion of the attaching portion may be positioned over the upper absorbing portion.

The upper absorbing portion and at least a portion of the floor cleaning portion may be made of a same material.

The floor cleaning portion may comprise a first section comprising threads and a second section comprising threads that are thicker than the threads of the first section. The upper absorbing portion and the first section may be made of a same material.

The first section and the second section may be formed in a straight shape or a curved shape, and the first section and the second section may be alternately arranged.

A width of the first section may be larger than a width of the second section.

The first section may be made of microfibers, and the second section may be made of polyester.

An area of the first section may be larger than an area of the second section.

The mop may further comprise a water absorbing portion positioned between the upper absorbing portion and the floor cleaning portion.

The mop may further comprise a center opening formed through the upper absorbing portion, the water absorbing portion, and the floor cleaning portion.

A first portion of the attaching portion may be in contact with the water absorbing portion and a second portion of the attaching portion may be in contact with the upper absorbing portion.

A nozzle for a cleaner according to another aspect comprises a nozzle housing and a rotation cleaning unit rotatably disposed under the nozzle housing. The rotation cleaning unit comprises a mop for cleaning a floor and a rotation plate coupled to the mop. The nozzle also comprises a driving device disposed in the nozzle housing and having a motor configured to drive the rotation cleaning unit. The mop comprises a floor cleaning portion, an upper absorbing portion disposed above the floor cleaning portion and configured to absorb water supplied from the water tank, an attaching portion configured to be attached to the rotation plate and sewn to the upper absorbing portion, and an edge sewn portion surrounding a plurality of edges of the attaching portion and the floor cleaning portion.

The upper absorbing portion and at least a portion of the floor cleaning portion may be made of a same material.

The nozzle may further comprise a water absorbing portion positioned between the upper absorbing portion and the floor cleaning portion.

DETAILED DESCRIPTION OF THE EMBODIMENTS

Figure 1:
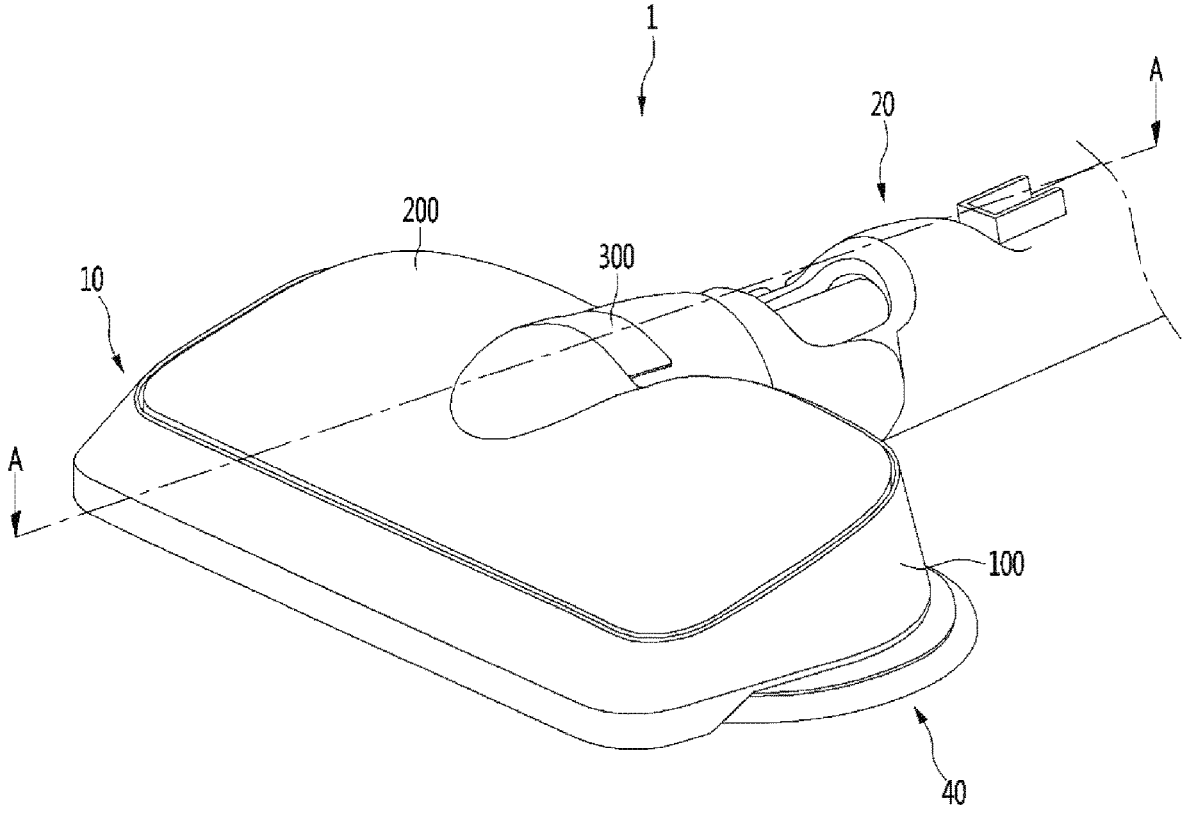
FIG. 1 is a perspective view illustrating a nozzle for a cleaner according to an embodiment of the present disclosure.

Hereinafter, some embodiments of the present disclosure will be described in detail with reference to the accompanying drawings. It should be noted that when components in the drawings are designated by reference numerals, the same components have the same reference numerals as far as possible even though the components are illustrated in different drawings. Further, in description of embodiments of the present disclosure, when it is determined that detailed descriptions of well-known configurations or functions disturb understanding of the embodiments of the present disclosure, the detailed descriptions will be omitted.

Also, in the description of the embodiments of the present disclosure, the terms such as first, second, A, B, (a) and (b) may be used. Each of the terms is merely used to distinguish the corresponding component from other components, and does not delimit an essence, an order or a sequence of the corresponding component. It should be understood that when one component is "connected", "coupled" or "joined" to another component, the former may be directly connected or jointed to the latter or may be "connected", coupled" or "joined" to the latter with a third component interposed therebetween.

Figure 2:
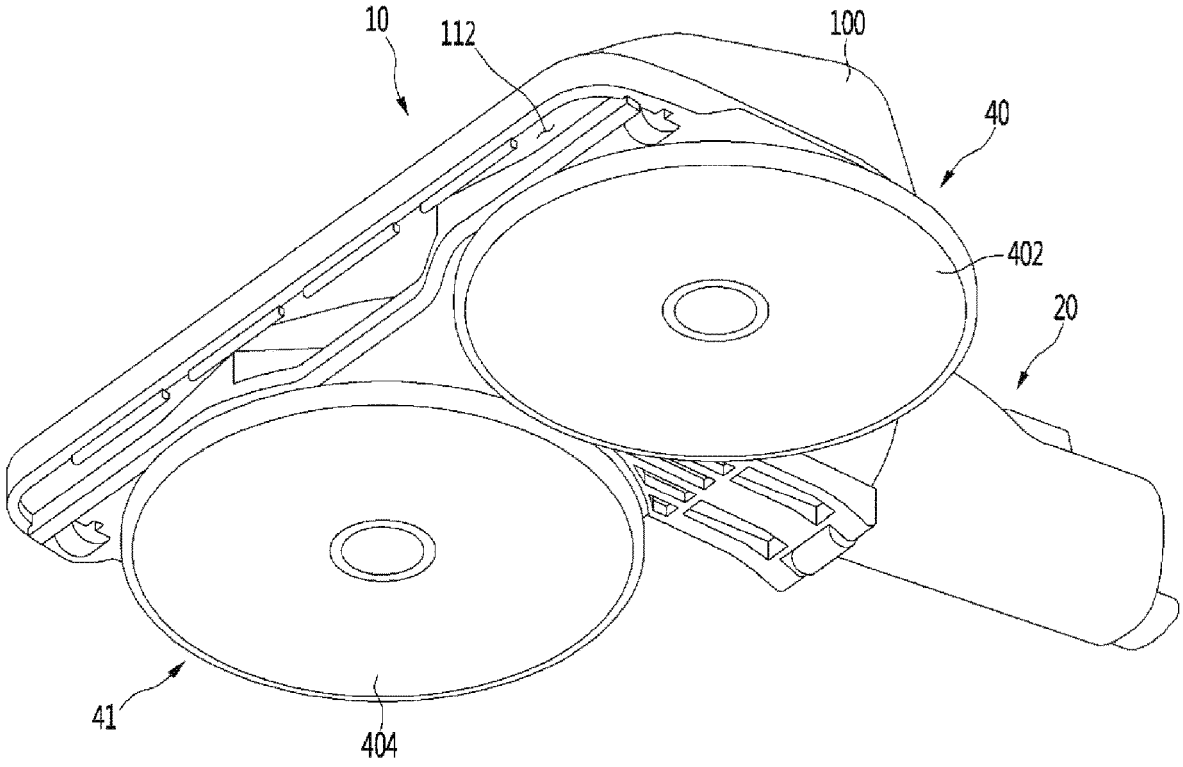
FIG. 2 is another perspective view of the nozzle for the cleaner of FIG. 1 according to an embodiment of the present disclosure.
Figure 3:
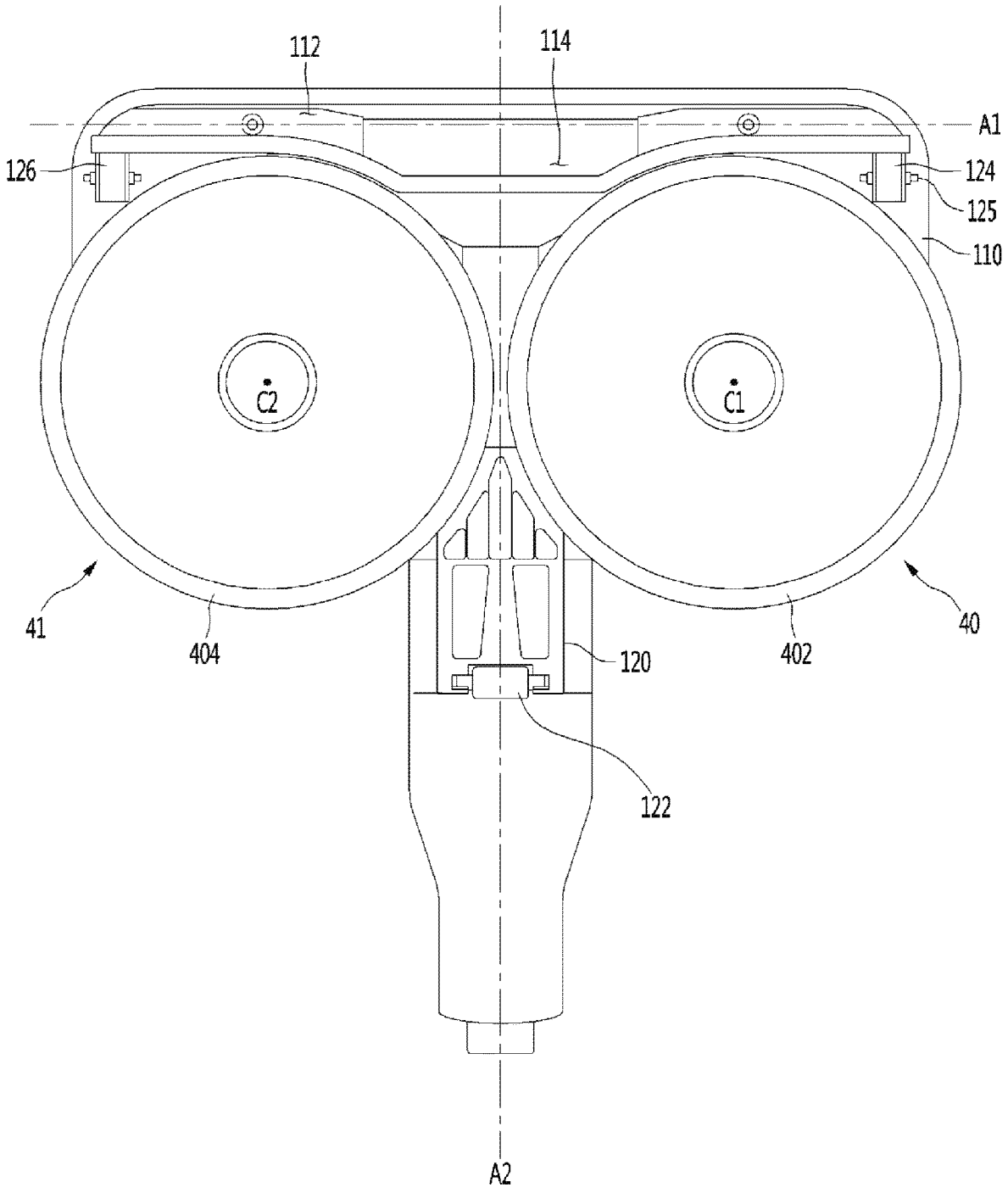
FIG. 3 is a bottom view illustrating a nozzle for a cleaner according to an embodiment of the present disclosure.
Figure 4:
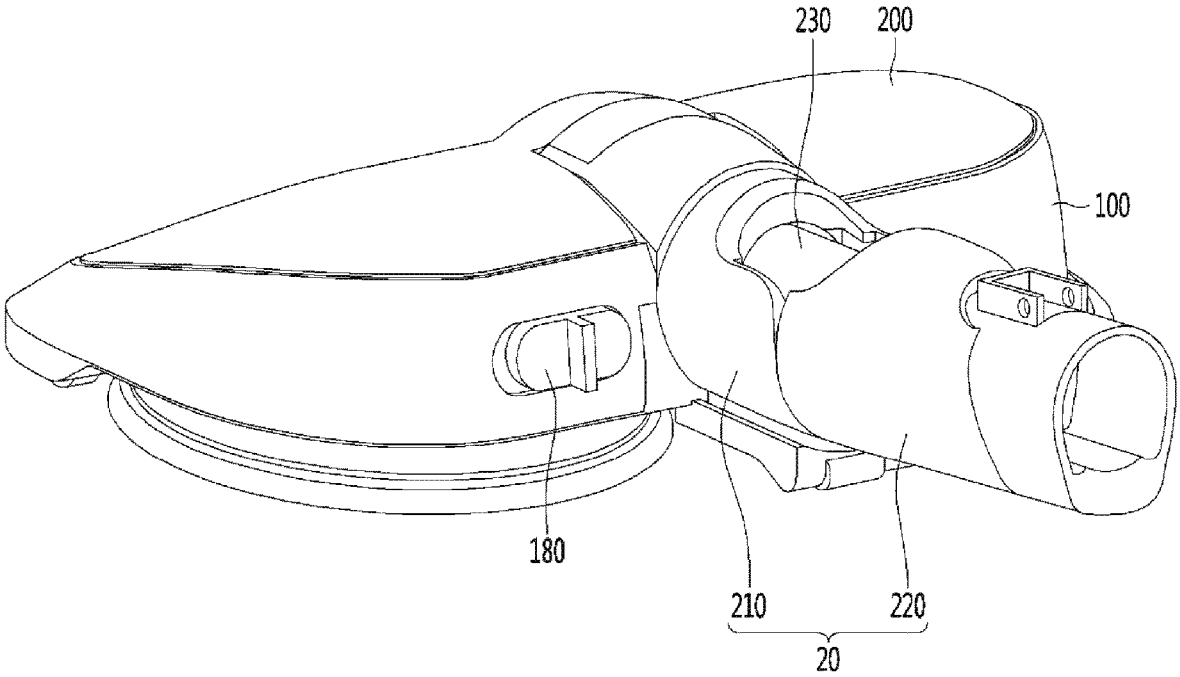
FIG. 4 is a perspective view illustrating the nozzle for the cleaner of FIG. 1 viewed from the rear side according to an embodiment of the present disclosure.
Figure 5:
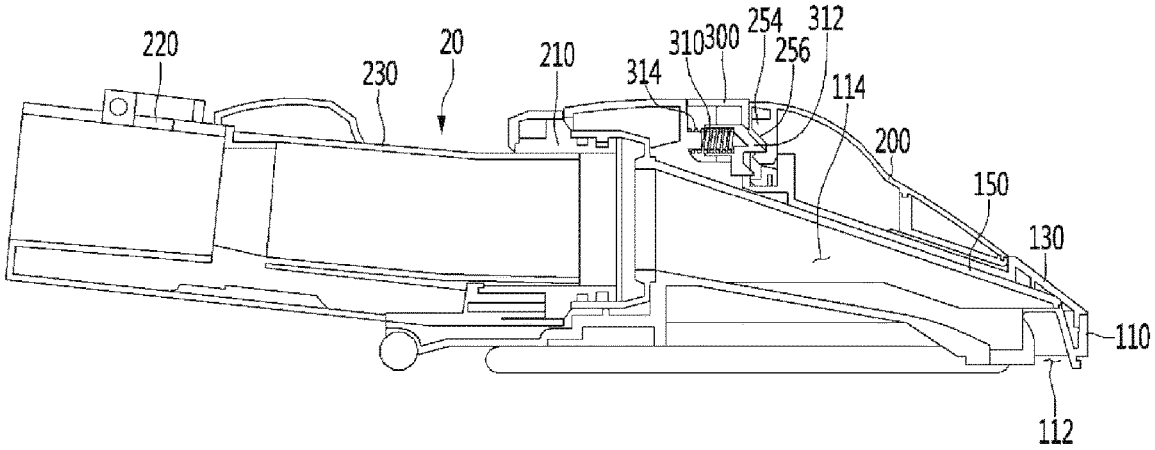
FIG. 5 is a sectional view taken along line A-A of FIG. 1 according to an embodiment of the present disclosure.

FIG. 1 and FIG. 2 are perspective views illustrating a nozzle for a cleaner according to an embodiment of the present disclosure, FIG. 3 is a bottom view illustrating a nozzle for a cleaner according to an embodiment of the present disclosure, FIG. 4 is a perspective view illustrating the nozzle for the cleaner of FIG. 1 viewed from the rear side, and FIG. 5 is a sectional view taken along line A-A of FIG. 1.

Referring to FIG. 1 to FIG. 5, a nozzle 1 of a cleaner (hereinafter referred to as "nozzle") according to an embodiment of the present disclosure may comprise a nozzle main body 10 and a connection tube 20 connected to the nozzle main body 10 so as to be capable of moving.

The nozzle 1 of the present embodiment can be used, for example, in a state of being connected to a handy-type cleaner or connected to a canister-type cleaner.

The nozzle 1 may comprise a battery to supply power to the power consumption unit therein, or can be operated by receiving power from the cleaner.

Since the cleaner to which the nozzle 1 is connected may comprise a suction motor, a suction force generated by the suction motor may apply to the nozzle 1 to be capable of suctioning foreign matter and air on the floor at the nozzle 1.

Accordingly, in the present embodiment, the nozzle 1 can perform a function of suctioning foreign matter and air on the bottom surface and guiding the foreign matter and air to the cleaner.

Although not limited thereto, the connection tube 20 may be connected to the rear central portion of the nozzle main body 10 to guide the suctioned air to the cleaner.

The nozzle 1 may further comprise rotation cleaning units 40 and 41 rotatably disposed below the nozzle main body 10.

For example, a pair of rotation cleaning units 40 and 41 may be arranged in the lateral direction. The pair of rotation cleaning units 40 and 41 can be independently rotated. For example, the nozzle 1 may include a first rotation cleaning unit 40 and a second rotation cleaning unit 41.

Each of the rotation cleaning units 40 and 41 may include mops 402 and 404. The mops 402 and 404 may be formed in a disc shape, for example. The mops 402 and 402 may include a first mop 402 and a second mop 404.

The nozzle main body 10 may include a nozzle housing 100 forming an outer shape. The nozzle housing 100 may include a suction flow path 112 and 114 for suctioning air.

The suction flow path 112 and 114 may include a first flow path 112 extending in the lateral direction in the nozzle housing 100 and a second flow path 114 communicating with the first flow path 112 and extending in the front and rear direction.

The first flow path 112 may be formed at a front end portion of the lower surface of the nozzle housing 100, as an example.

The second flow path 114 may extend rearward from the first flow path 112. For example, the second flow path 114 may extend rearward from the central portion of the first flow path 112 toward the connection tube 20.

Accordingly, a centerline A1 of the first flow path 112 can extend in the lateral horizontal direction. A centerline A2 of the second flow path 114 can extend in the front and rear direction and can intersect the first flow path 112.

The centerline A2 of the second flow path 114 may be positioned at a position where the nozzle main body 10 is bisected right and left, as an example.

A portion of the mops 402 and 404 may protrude to the outside of the nozzle 1 in a state where the rotation cleaning units 40 and 41 are connected to the lower side of the nozzle main body 10, and thus, the rotation cleaning units 40 and 41 can clean not only a floor positioned directly below the nozzle but also the floor positioned outside the nozzle 1.

For example, the mops 402 and 404 may protrude not only to both sides of the nozzle 1 but also to the rear of the nozzle 1.

The rotation cleaning units 40 and 41 may be positioned on the rear side of the first flow path 112 from below the nozzle main body 10, for example.

Therefore, when the nozzle 1 is advanced and cleaned, the floor can be cleaned by the mops 402, 404 after foreign substances and air on the floor are suctioned by the first flow path 112.

In the present embodiment, the first rotation center C1 of the first rotation cleaning unit 40 (for example, rotation center of rotation plate 420) and the second rotation center C2 of the second rotation cleaning unit 41 (for example, rotation center of rotation plate 440) may be spaced apart from each other in the lateral direction.

The centerline A2 of the second flow path 114 may be positioned in a region between the first rotation center C1 and the second rotation center C2.

The nozzle housing 100 may include a nozzle base 110 and a nozzle cover 130 coupled to the upper side of the nozzle base 110.

The nozzle base 110 may form the first flow path 112. The nozzle housing 100 may further include a flow path forming portion 150 forming the second flow path 114 together with the nozzle base 110.

The flow path forming portion 150 may be coupled to the upper central portion of the nozzle base 110 and the end portion of the flow path forming portion 150 may be connected to the connection tube 20.

Accordingly, by disposing the flow path forming portion 150, the second flow path 114 can extend substantially straight forward and backward, so the length of the second flow path 114 can be minimized. Accordingly, a loss of flow path in the nozzle 1 can be minimized.

Accordingly, since the second flow path 114 can extend substantially in a straight line in the front and rear direction by the disposition of the flow path forming portion 150, the length of the second flow path 114 can be minimized, and thus the flow path loss in the nozzle 1 can be minimized.

The front portion of the flow path forming portion 150 may cover the upper side of the first flow path 112. The flow path forming portion 150 may be inclined upward from the front end portion toward the rear side.

Therefore, the height of the front portion of the flow path forming portion 150 may be lower than that of the rear portion of the flow path forming portion 150.

According to the present embodiment, since the height of the front portion of the flow path forming portion 150 is low, there is an advantage that the height of the front portion of the entire height of the nozzle 1 can be reduced. The lower the height of the nozzle 1, the more likely it may be that the nozzle 1 can be drawn into a narrow space on the lower side of furniture or a chair to be cleaned.

The nozzle base 110 may include an extension portion 120 for supporting the connection tube 20. The extension portion 120 may extend rearward from the rear end of the nozzle base 110.

The connection tube 20 may include a first connection tube 210 connected to an end of the flow path forming portion 150, a second connection tube 220 rotatably connected to the first connection tube 210, and a guide tube 230 for communicating the first connection tube 210 with the second connection tube 220.

The first connection tube 210 may be seated on the extension portion 120, and the second connection tube 220 may be connected to an extension tube or a hose of the cleaner.

A plurality of rollers for smooth movement of the nozzle 1 may be provided on the lower side of the nozzle base 110.

For example, the first roller 124 and the second roller 126 may be positioned behind the first flow path 112 on the nozzle base 110. The first roller 124 and the second roller 126 may be spaced apart from each other in the lateral direction.

According to the present embodiment, the first roller 124 and the second roller 126 may be disposed behind the first flow path 112 so that the first flow path 112 can be positioned as close as possible to the front end portion of the nozzle base 110, and thus, the area which can be cleaned by using the nozzle 1 can be increased.

As the distance from the front end portion of the nozzle base 110 to the first flow path 112 increases, the area in which the suction force does not apply in front of the first flow path 112 during the cleaning process may increase, and thus, the area where the cleaning is not performed may be increased.

On the other hand, according to the present embodiment, the distance from the front end portion of the nozzle base 110 to the first flow path 112 can be minimized, and thus, the cleanable area can be increased.

In addition, by disposing the first roller 124 and the second roller 126 behind the first flow path 112, the length of the first flow path 112 in the lateral direction can be maximized.

In other words, the distance between both end portions of the first flow path 112 and both end portions of the nozzle base 110 can be minimized.

In the present embodiment, the first roller 124 may be positioned in a space between the first flow path 112 and the first mop 402. The second roller 126 may be positioned in a space between the first flow path 112 and the second mop 404.

The first roller 124 and the second roller 126 may be rotatably connected to a shaft 125, respectively. The shaft 125 may be fixed to the lower side of the nozzle base 110 so as to extend in the lateral direction.

The distance between the shaft 125 and the front end portion of the nozzle base 110 may be longer than the distance between the front end portion of the nozzle base 110 and each of the mops 402 and 404 (or a rotation plate described later).

At least a portion of each of the rotation cleaning units 40 and 41 (mop and/or rotation plate) can be positioned between the shaft 125 of the first roller 124 and the shaft 125 of the second roller 126.

According to this disposition, the rotation cleaning units 40 and 41 can be positioned as close as possible to the first flow path 112, and the area to be cleaned by the rotation cleaning units 40 and 41 of the floor on which the nozzles 1 are positioned can be increased, and thus, the floor cleaning performance can be improved.

A number of the plurality of rollers may not be limited. However, the nozzle 1 can be supported at three points. In other words, the plurality of rollers may further include a third roller 127 provided on the extension portion 120 of the nozzle base 110.

The third roller 127 may be positioned behind the mops 402, 404 to prevent interference with the mops 402, 404.

The nozzle main body 10 may further include a water tank 200 configured to supply water to the mops 402 and 404.

The water tank 200 may be detachably connected to the nozzle housing 100. The water in the water tank 200 can be supplied to each of the mops 402 and 404 when the water tank 200 is mounted on the nozzle housing 100.

The nozzle main body 10 may further include an operating unit 300 that operates to separate the water tank 200 when the water tank 200 is mounted on the nozzle housing 100.

The operating unit 300 may be disposed in the nozzle housing 100 as an example. The nozzle housing 100 may comprise a first coupling unit 310 for coupling with the water tank 200 and the water tank 200*a* may comprise a second coupling unit 254 for coupling with the first coupling unit 310.

The operating unit 300 may be disposed so as to be capable of vertically moving in the nozzle housing 100. The first coupling unit 310 can be moved under the operation force of the operating unit 300 at the lower side of the operating unit 300.

For example, the first coupling unit 310 may move in the front and rear direction. For this purpose, the operating unit 300 and the first coupling unit 310 may include inclined surfaces in contact with each other.

When the operating unit 300 is lowered by the inclined surfaces, the first coupling unit 310 can move horizontally.

The first coupling unit 310 may comprise a hook 312 for engaging with the second coupling unit 254 and the second coupling unit 254 may comprise a groove 256 for inserting the hook 312.

The first coupling unit 310 may be resiliently supported by an elastic member 314 so as to maintain a state where the first coupling unit 310 is coupled to the second coupling unit 254.

In the present embodiment, the operating unit 300 may be positioned directly above the second flow path 114, for example. For example, the operating unit 300 may be disposed to overlap the centerline A2 of the second flow path 114 in the vertical direction.

Meanwhile, the nozzle main body 10 may further comprise an adjusting unit 180 for adjusting the amount of water discharged from the water tank 200. For example, the adjusting unit 180 may be positioned on the rear side of the nozzle main body 10.

The adjusting unit 180 can be operated by a user and the adjusting unit 180 can prevent the water from being discharged from the water tank 200 or the water from being discharged.

Alternatively, the amount of water discharged from the water tank 200 can be adjusted by the adjusting unit 180. For example, when the adjusting unit 180 is operated, water may be discharged from the water tank 200 by a first amount per unit time, or water may be discharged by a second amount greater than the first amount per unit time.

Figure 6:
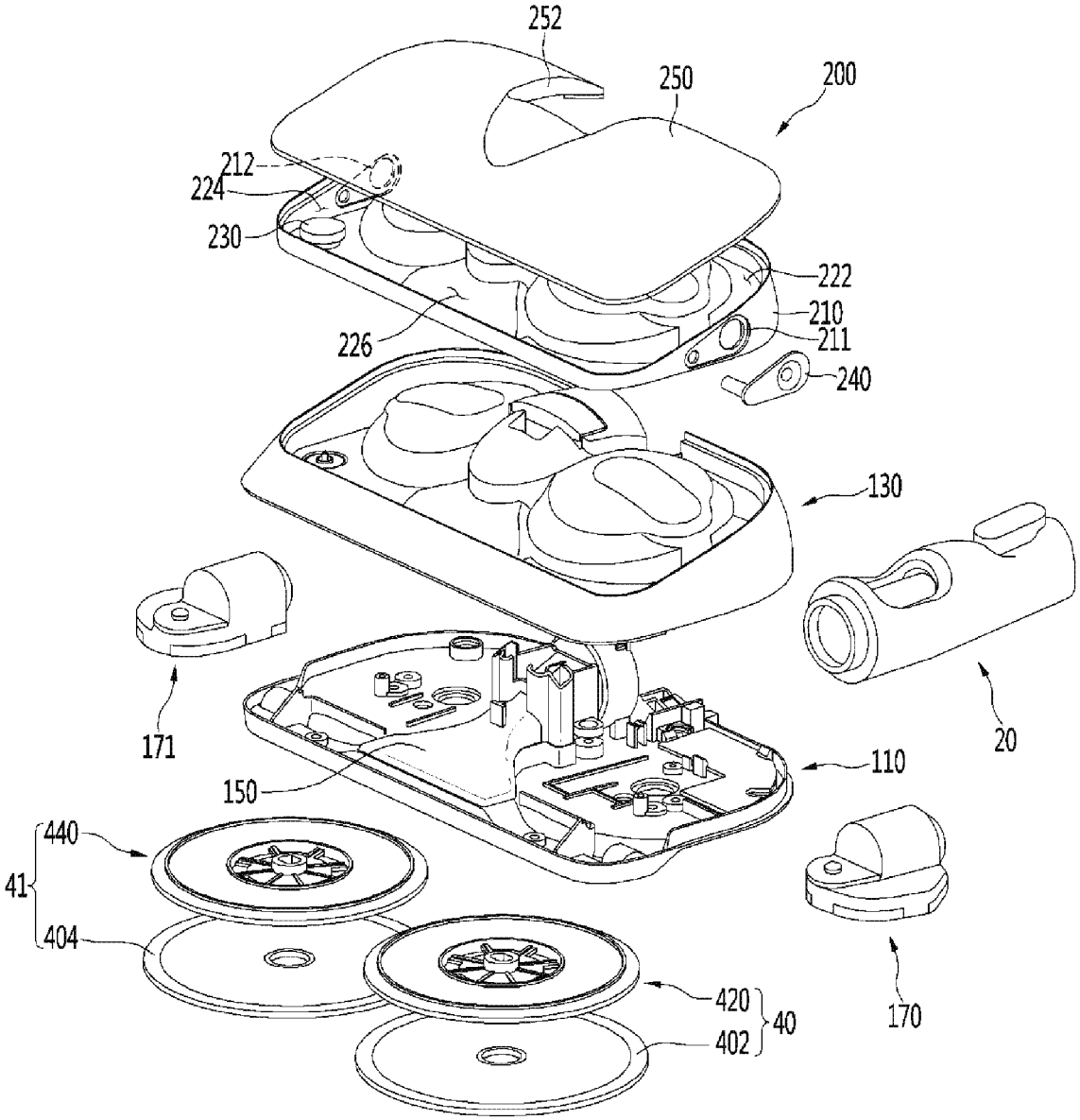
FIG. 6 is an exploded perspective view illustrating a nozzle according to an embodiment of the present disclosure.
Figure 7:
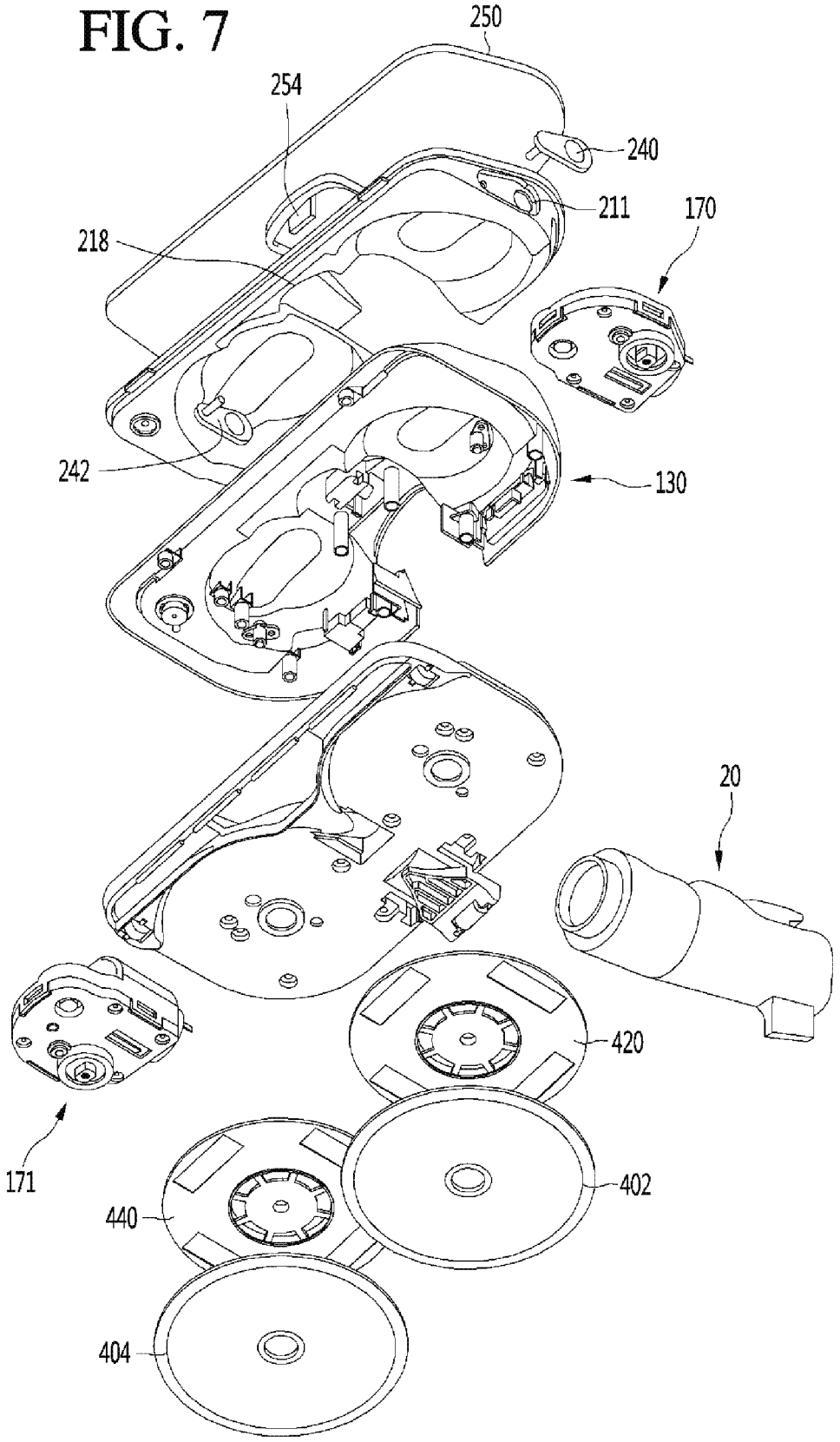
FIG. 7 is another exploded perspective view of the nozzle of FIG. 6 according to an embodiment of the present disclosure.
Figure 8:
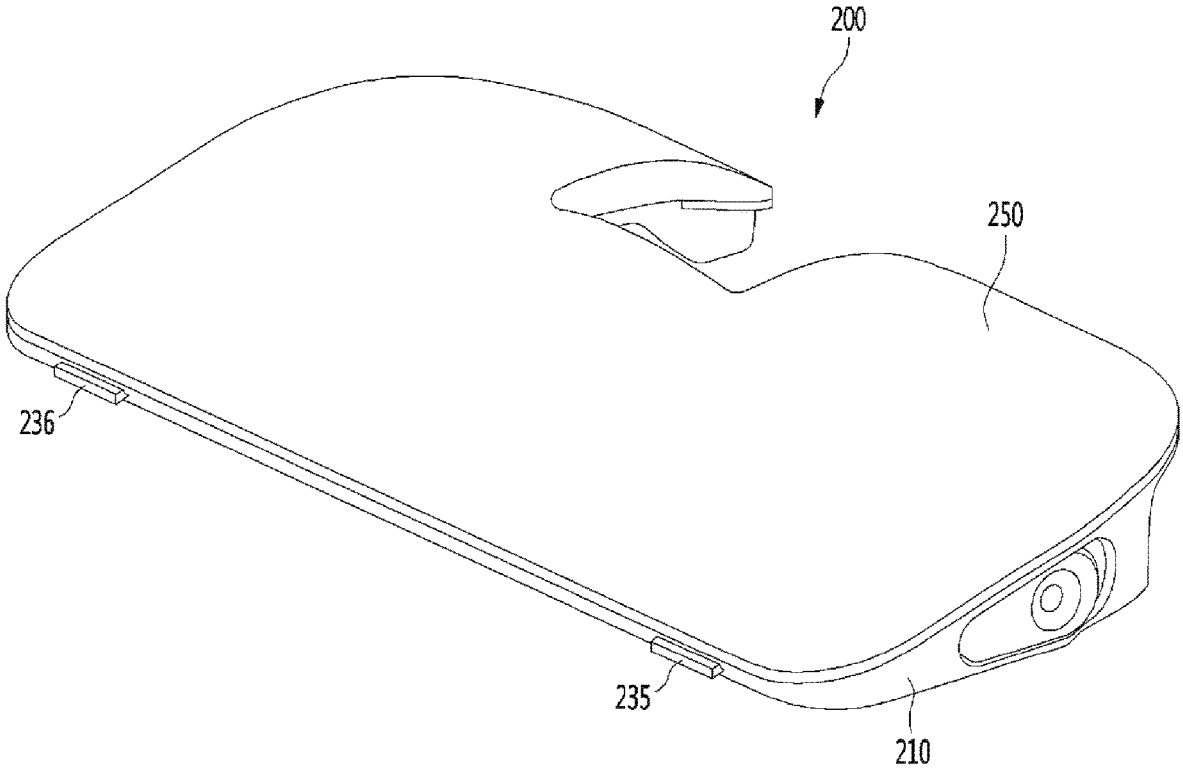
FIG. 8 is a perspective view illustrating a water tank according to an embodiment of the present disclosure.
Figure 9:
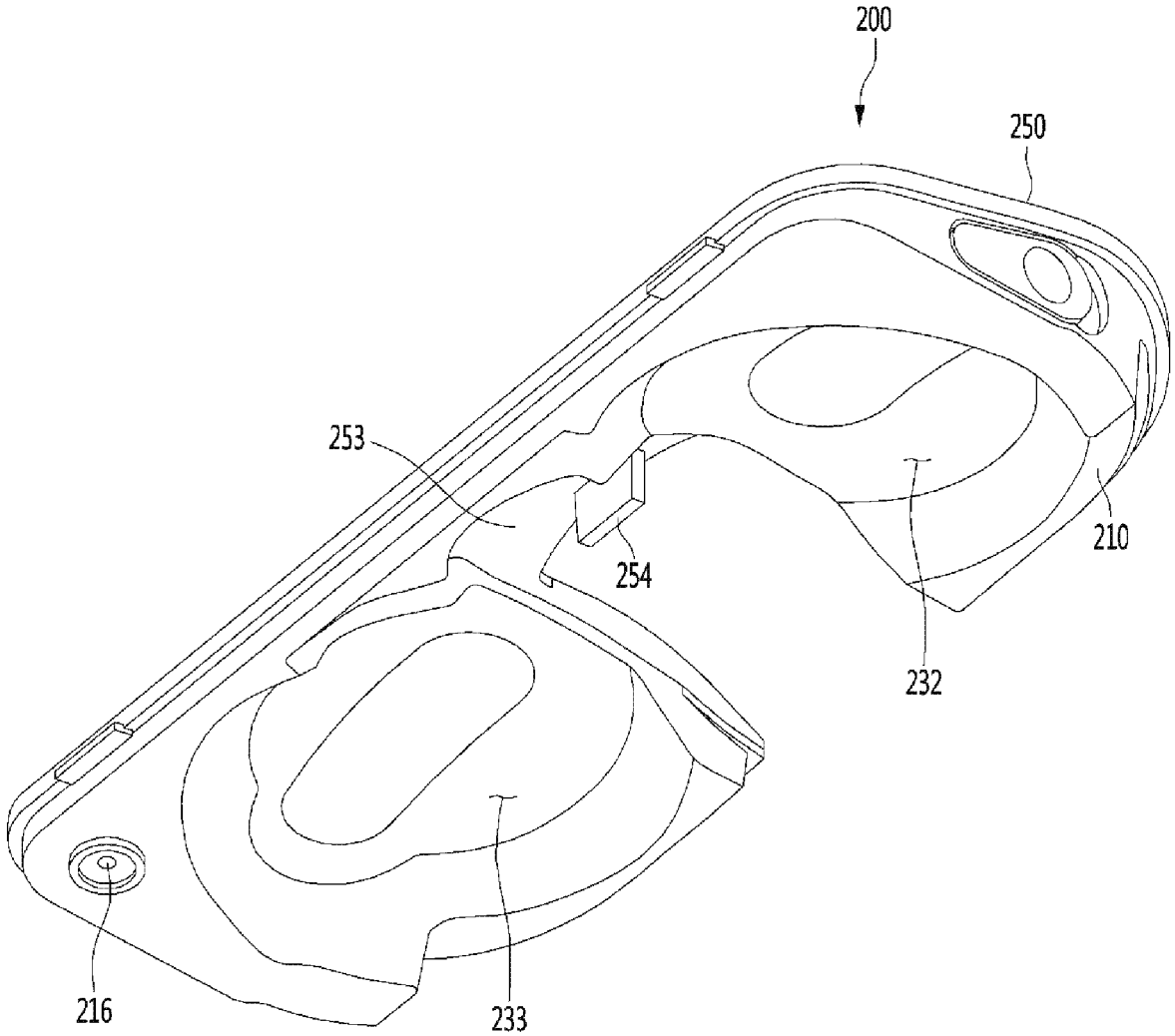
FIG. 9 is another perspective view of the water tank of FIG. 8 according to an embodiment of the present disclosure.

FIG. 6 and FIG. 7 are exploded perspective views of a nozzle according to an embodiment of the present disclosure, and FIG. 8 and FIG. 9 are perspective views of a water tank according to an embodiment of the present disclosure.

Referring to FIG. 3 and FIG. 6 to FIG. 9, the nozzle main body 10 may further include a plurality of driving devices 170 and 171 for individually driving the respective rotation cleaning units 40 and 41.

The plurality of driving devices 170 and 171 may include a first driving device 170 for driving the first rotation cleaning unit 40 and a second driving device 171 for driving the second rotation cleaning unit 41.

Since each of the driving devices 170 and 171 operates individually, even if some of the driving devices 170 and 171 fail, there is an advantage that some of the rotation cleaning devices can be rotated by another driving device.

The first driving device 170 and the second driving device 171 may be spaced apart from each other in the lateral direction in the nozzle main body 10.

The driving devices 170 and 171 may be positioned behind the first flow path 112.

For example, at least a portion of the second flow path 114 may be positioned between the first driving device 170 and the second driving device 171. Therefore, even if the plurality of driving devices 170 and 171 are provided, the second flow path 114 may not be affected, and thus, the length of the second flow path 114 can be minimized.

According to the present embodiment, since the first driving device 170 and the second driving device 171 are disposed on both sides of the second flow pathway 114, the weight of the nozzle 1 can be uniformly distributed to the left and right so that it may be possible to prevent the center of gravity of the nozzle 1 from being biased toward any one of the nozzles 1.

The plurality of driving devices 170 and 171 may be disposed in the nozzle main body 10. For example, the plurality of driving devices 170 and 171 may be seated on the upper side of the nozzle base 110 and covered with the nozzle cover 130.

Each of the rotation cleaning units 40 and 41 may further include rotation plates 420 and 440 which may be rotated by receiving power from each of the driving devices 170 and 171.

The rotation plates 420 and 440 may include a first rotation plate 420 connected to the first driving device 170 and a second rotation plate 420 connected to the second driving device 171. The first mop 402 may be attached to the first rotation plate 420, and the second mop 404 may be attached to the second rotation plate 440.

The first and second rotation plates 420 and 440 may be formed in a disc shape, and the mops 402 and 404 may be attached to the bottom surface of the first and second rotation plates 420 and 440.

Water Tank

The water tank 200 may be mounted on the upper side of the nozzle housing 100. For example, the water tank 200 may be seated on the nozzle cover 130. The water tank 200 can form a portion of an appearance of the upper surface of the nozzle main body 10 when the water tank 200 is seated on the upper side of the nozzle cover 130.

The water tank 200 may include a first body 210, and a second body 250 coupled to the first body 210 and the water tank 200 may define a chamber in which water is stored together with the first body 210.

The chamber may include a first chamber 222 positioned above the first driving device 170, a second chamber 224 positioned above the second driving device 171, and a connection chamber 226 communicating the first chamber 222 with the second chamber 224 and positioned above the second flow path 114.

In the present embodiment, the volume of the connection chamber 226 may be smaller than the volumes of the first chamber 222 and the second chamber 224 so that the amount of water to be stored is increased while minimizing the height of the nozzle 1 by the water tank 200.

The water tank 200 may be formed so that the front height is low and the rear height is high. The connection chamber 226 may connect the first chamber 222 and the second chamber 224 disposed on both sides in the front portion of the water tank 200 to reduce a height of a front portion of the nozzle 1.

The water tank 200 may have a first inlet 211 for introducing water into the first chamber 222 and a second inlet 212 for introducing water into the second chamber 224.

The first inlet 211 may be covered by a first inlet cover 240 and the second inlet 212 may be covered by a second inlet cover 242. For example, each inlet cover 240 and 242 may be formed of a rubber material.

The first and second inlets 211, 212 may be provided in the first body 210.

The heights of both sides of the first body 210 may be the smallest at the front ends and may increase toward the rear ends.

In order to secure the sizes of the inlets 211 and 212, the inlets 211 and 212 may be positioned closer to the rear end than the front end of the first body 210.

The first body 210 may include a first slot 218 for preventing interference with the operating unit 300 and the coupling units 310 and 254.

The second body 250 may include a second slot 252 for preventing interference with the operating unit 3.

The second body 250 may further include a slot cover 253 for covering a portion of the first slot 218 of the first body 210 in a state of being coupled to the first body 210.

The second coupling unit 254 may extend downward from the slot cover 253. Accordingly, the second coupling unit 254 may be positioned within the space formed by the first slot 218.

The water tank 200 may further include coupling ribs 235 and 236 for coupling with the nozzle cover 130 before the second coupling unit 254 of the water tank 200 is coupled with the first coupling unit 310.

The coupling ribs 235 and 236 may also guide the coupling position of the water tank 200 in the nozzle cover 130 before the second coupling unit 254 of the water tank 200 is coupled with the first coupling unit 310.

For example, a plurality of coupling ribs 235 and 236 may protrude from the first body 110 and may be disposed so as to be spaced apart in the left and rear horizontal direction.

Though not limited, the plurality of coupling ribs 235 and 236 may protrude forward from a front surface of the first body 210 and may be spaced apart from each other in the lateral direction.

Each of the driving devices 170 and 171 may be provided in the nozzle main body 10 so that a portion of the nozzle main body 10 may protrude upward at both sides of the second flow path 114 by each of the driving devices 170 and 171.

The water tank 200 may have a pair of receiving spaces 232 and 233 to prevent interference with the portions protruding from the nozzle main body 10. The pair of receiving spaces 232 and 233, for example, may be formed by recessing a portion of the first body 210 upward. The pair of receiving spaces 232 and 233 may be divided into right and left by the first slot 218.

The water tank 200 may further comprise a discharge port for discharging water from the water tank 200.

A discharge port 216 for discharging water from the water tank 200 may be formed in any one of the pair of the first wall portions 214*b*. The discharge port 216 may be opened or closed by a valve 230. The valve 230 may be disposed in the water tank 200.

In the present embodiment, the discharge port 216 may be positioned under any one of the first chamber 222 and the second chamber 224. That is, the water tank 200 may have a single discharge port 216.

The reason that the water tank 200 has the single discharge port 216 may be for reducing the number of portions where water can leak.

That is, there are parts (a control board, a driving motor, etc.) that may be operated by receiving power in the nozzle 1, so contact with water could be completely prevented. In order to prevent contact with water, fundamentally, leakage at the portions through which water is discharged from the water tank 200 should be prevented.

The more the number of the discharge port 216 of the water tank 200, the more the structure for preventing leakage may be additionally required, so the entire structure may be complicated. Further, even if there is a structure for preventing leakage, leakage may not be completely prevented.

Further, the more the number of the discharge port 216 of the water tank 200, the more the number of the valve 230 for opening/closing the discharge port 216 may be required. This means that not only the number of parts may increase, but the volume of the water in the water tank 200 may be reduced by the valve 230.

Since the height is larger at the rear than the front of the water tank 200, the discharge port 216 may be positioned close to the front end of the first body 210 so that the water in the water tank 200 can be smoothly discharged.

Nozzle Cover

Figure 10:
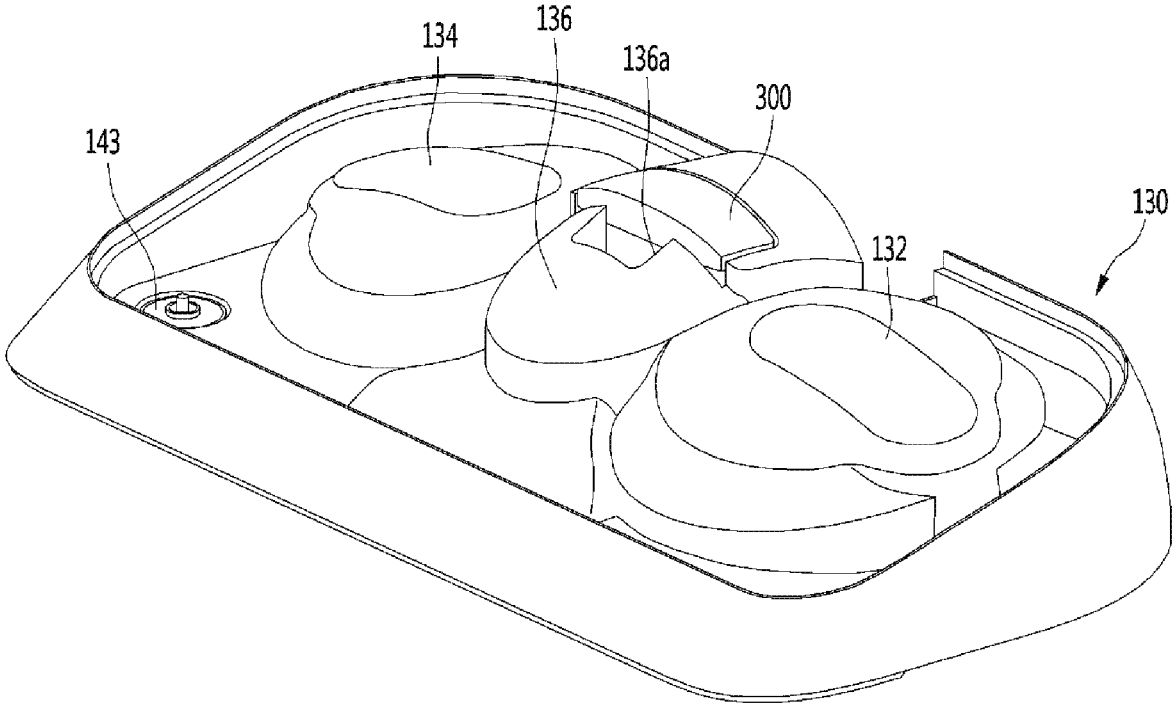
FIG. 10 is a perspective view showing a nozzle cover viewed from the top according to an embodiment of the present disclosure.
Figure 11:
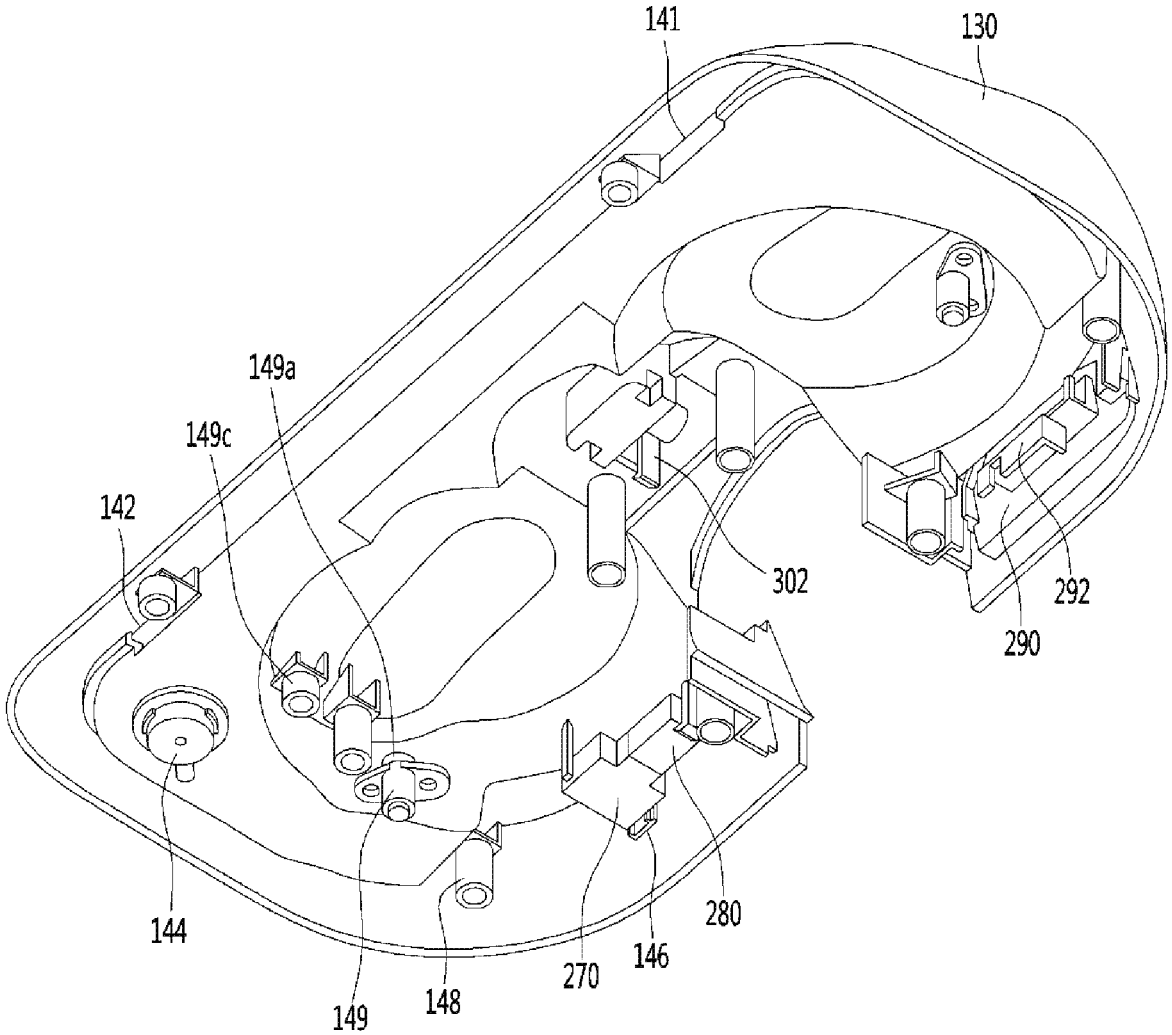
FIG. 11 is a perspective view showing the nozzle cover viewed from the bottom according to an embodiment of the present disclosure.

FIG. 10 is a perspective view illustrating a nozzle cover according to an embodiment of the present disclosure as viewed from above, and FIG. 11 is a perspective view illustrating a nozzle cover according to an embodiment of the present disclosure as viewed from below.

Figure 15:
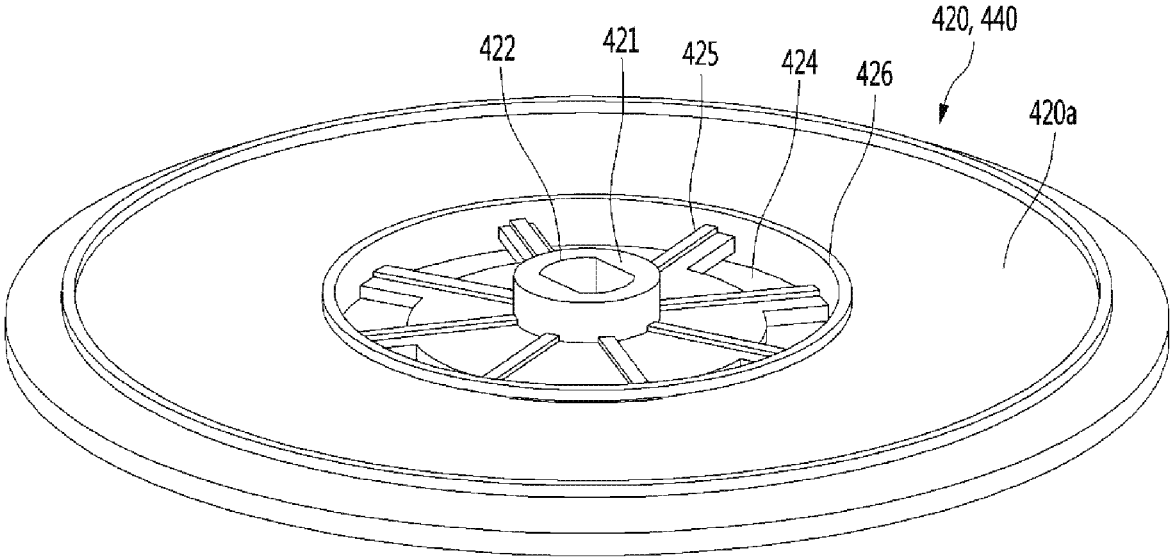
FIG. 15 is a view showing a rotary plate viewed from the top according to an embodiment of the present disclosure.

Referring to FIG. 10 and FIG. 15, the nozzle cover 130 may include driving unit covers 132 and 134 that cover the upper side of each of the driving units 170 and 171.

Each of the driving unit covers 132 and 134 may be a portion which protrudes upward from the nozzle cover 130. Each of the driving unit covers 132 and 134 can surround the upper side of the driving devices 170 and 171 installed in the nozzle base 110.

When the water tank 200 is seated on the nozzle cover 130, each of the driving unit cover 132 and 134 may be received in each of the receiving spaces 232 and 233 of the water tank 200, and thus interference between the components may be prevented.

In addition, in the water tank 200, the first chamber 222 and the second chamber 224 may be disposed so as to surround the periphery of each of the respective driving unit covers 132 and 134.

Thus, according to the present embodiment, the volumes of the first chamber 222 and the second chamber 224 can be increased.

The first body 210 of the water tank 200 may be seated at a lower portion of the nozzle cover 130 than the driving unit covers 132 and 134.

At least a portion of the bottom wall of the water tank 200 may be positioned lower than the axis of the driving motors A3 and A4. For example, the bottom wall of the first and second chambers may be positioned lower than the axis of the driving motors A3 and A4.

The nozzle cover 130 may further include a flow path cover 136 for covering the flow path forming portion 150. The flow path cover 136 may be positioned between the driving unit covers 132 and 134.

The flow path cover 316 can support the operating unit 300. The operating unit 300 may include a coupling hook 302 for coupling to the flow path cover 135. When the coupling hook 302 is coupled to the flow path cover 136, the operating unit 300 can be prevented from separating upward from the flow path cover 136.

An opening 136*a* through which the second coupling unit 254 can be inserted may be formed at the flow path cover 136. The first coupling unit 310 may be coupled to the second coupling unit 254 when the second coupling unit 254 of the water tank 200 is inserted into the opening 136*a*.

The flow path cover 136 may be positioned in a first slot 218 of the first body 210 and a second slot 252 of the second body 250. So as to increase the water storage capacity of the water tank 200, a portion of the water tank 200 may be positioned on both sides of the flow path cover 136.

The nozzle cover 130 may further include rib insertion holes 141 and 142 into which the coupling ribs 235 and 236 provided in the water tank 200 are inserted.

Accordingly, the water tank 200 may be moved downward in a state where the coupling ribs 235 and 236 are inserted into the rib insertion holes 141 and 142, and thus, the second coupling unit 254 may be coupled to the first coupling unit 310.

The nozzle cover 130 may be provided with a valve operating unit 144 for operating the valve 230 in the water tank 200. The valve operating unit 144 may be coupled to the nozzle cover 130. The valve operating unit 144 may be coupled to the lower side of the nozzle cover 130, and a portion of the valve operating unit 144 may protrude upward through the nozzle cover 130.

The nozzle cover 130 may be provided with a sealer 143 for preventing water discharged from the water tank 200 from leaking from the vicinity of the valve operating unit 144.

The nozzle cover 130 may comprise a water pump 270 for controlling water discharge from the water tank 200. The water pump 270 may be connected to a pump motor 280.

A pump installation rib 146 for installing the water pump 270 may be provided on the lower side of the nozzle cover 130.

The water pump 270 may comprise a pump that operates so as to communicate the inlet and the outlet by expanding or contracting the valve body therein while being operated, and the pump can be realized by a well-known structure, and thus a detailed description thereof will be omitted.

The valve body in the water pump 270 can be driven by the pump motor 280. Therefore, according to the present embodiment, water in the water tank 200 can be continuously and stably supplied to the rotation cleaning units 40 and 41 while the pump motor 280 is operating.

The operation of the pump motor 280 can be adjusted by operating the above-described adjusting unit 180. For example, the adjusting unit 180 may select the on/off state of the pump motor 280.

Alternatively, the output (or rotational speed) of the pump motor 280 may be adjusted by the adjusting unit 180.

A supporting portion 290 movably supporting the operating unit 180 may be disposed in the nozzle cover 130 and a variable resistor 292 may be connected to the operating unit 180. A signal for controlling the pump motor 280 may be changed on the basis of a change of resistance in accordance with a movement of the variable resistor 292.

The nozzle cover 130 may further include at least one fastening boss 148 to be coupled with the nozzle base 110.

In addition, the nozzle cover 130 may be provided with a spray nozzle 149 for spraying water to the rotation cleaning units 40 and 41. For example, a pair of spray nozzles 149 may be installed on the nozzle cover 130 in a state where the spray nozzles 149 are spaced apart from each other in the lateral direction.

The nozzle cover 130 may be provided with a nozzle installation boss 149*c* for mounting the spray nozzle 149. The spray nozzle 149 may include a connection unit 149*a* for connecting a branch tube to be described later.

Nozzle Base

Figure 21:
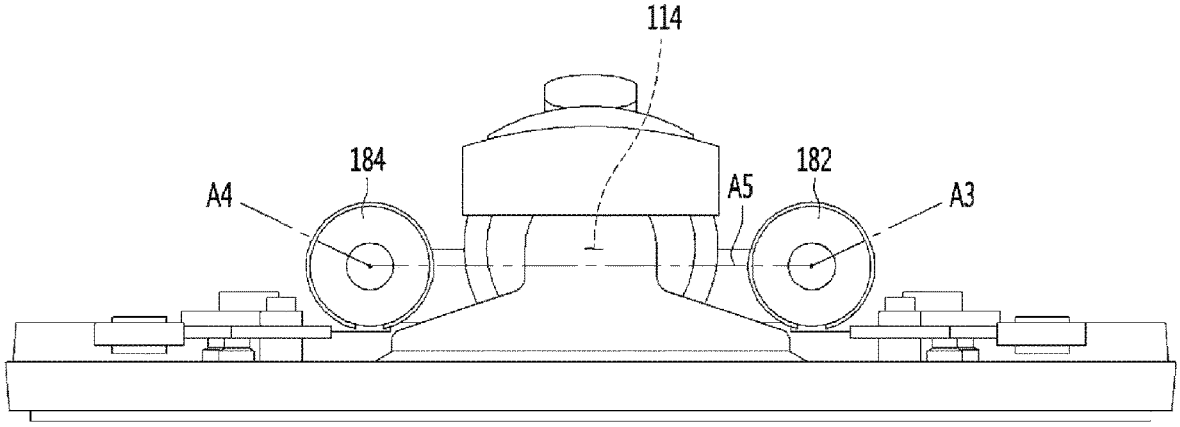
FIG. 21 is a front view showing a state when a driving device is installed on the nozzle base according to an embodiment of the present disclosure.
Figure 22:
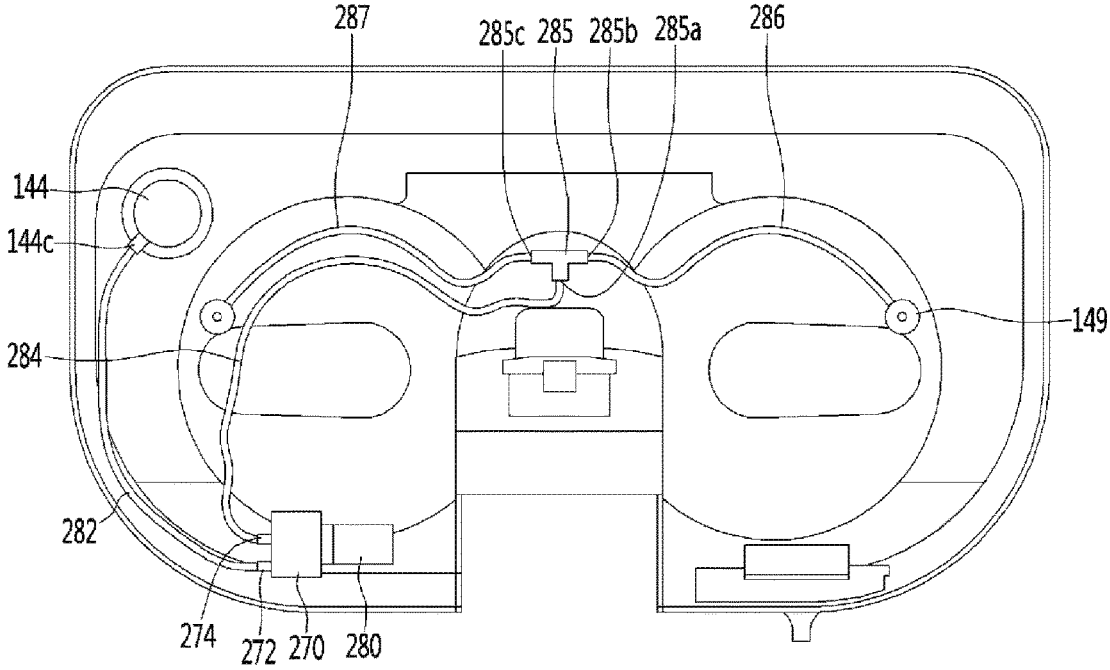
FIG. 22 is a view showing a water supply flow path for supplying water in a water tank to a rotary cleaning unit according to an embodiment of the present disclosure.

FIG. 21 is a view illustrating a state where a flow path forming portion is coupled to a nozzle base according to an embodiment of the present disclosure, and FIG. 22 is a view illustrating a nozzle base according to an embodiment of the present disclosure as viewed from below.

Figure 12:
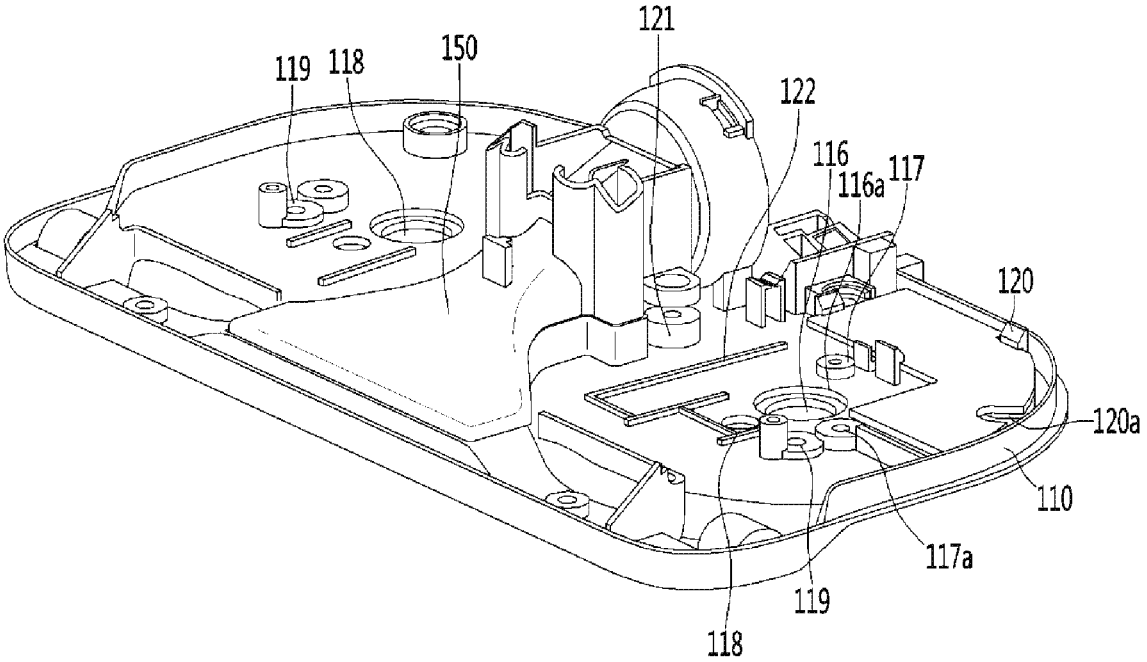
FIG. 12 is a view showing a state when a flow path forming portion is combined with a nozzle base according to an embodiment of the present disclosure.
Figure 13:
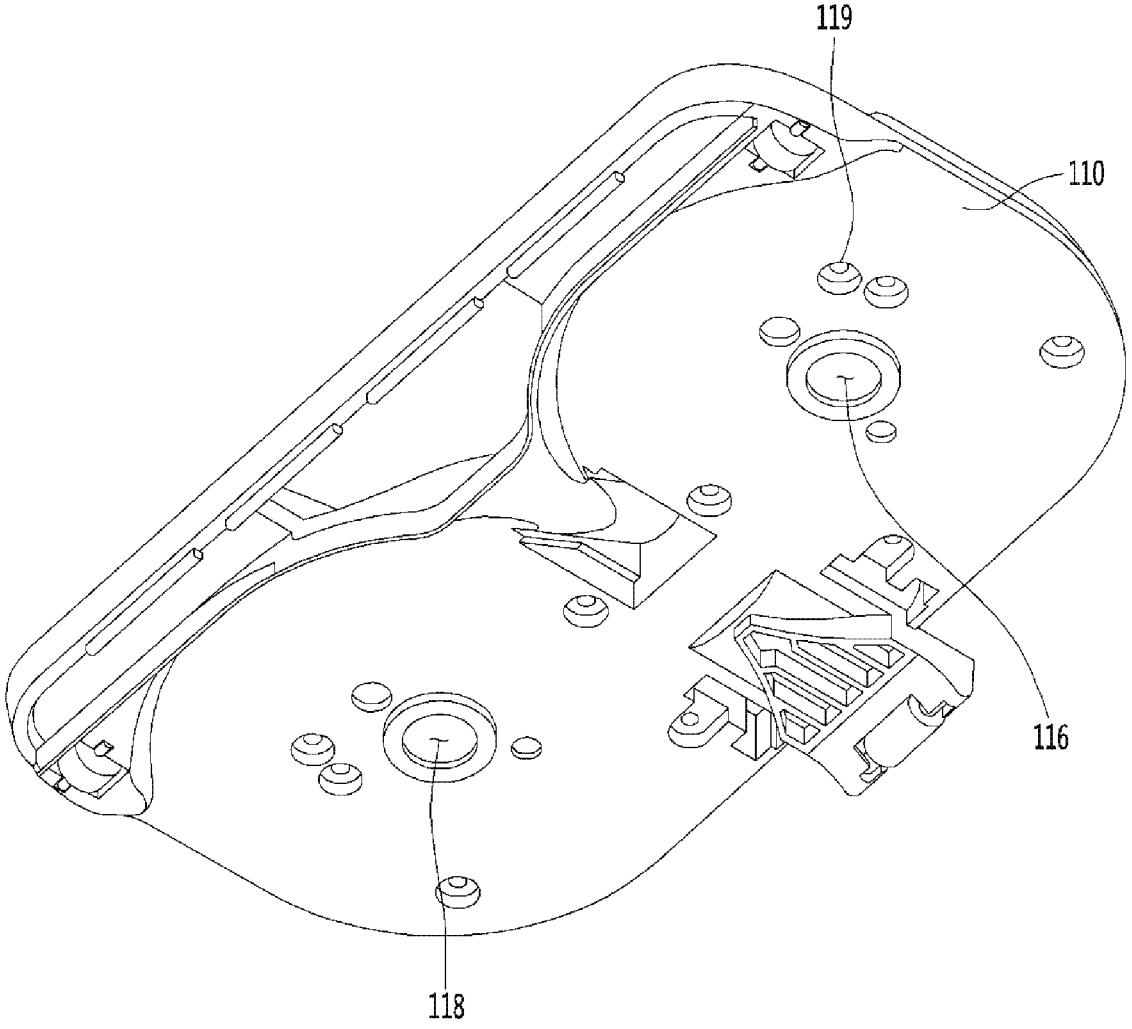
FIG. 13 is a perspective view of the nozzle base viewed from the bottom according to an embodiment of the present disclosure.

Referring to FIG. 6, FIG. 12, and FIG. 13, the nozzle base 110 may include a pair of shaft through-holes 116 and 118 through which a transmission shaft (to be described later) that is connected to each of the rotation plates 420 and 440 in each of the driving devices 170 and 171 may pass.

The nozzle base 110 may comprise a seating groove 116*a* for seating a sleeve provided in each of the driving devices 170 and 171, and the shaft through-holes 116 and 118 may be formed in the seating groove 116*a*.

Each of the shaft through-holes 116 and 118 may be disposed on both sides of the flow path forming portion 150 in a state where the flow path forming portion 150 is coupled to the nozzle base 110.

The nozzle base 110 may comprise a board installation portion 120 for installing a control board 115 for controlling each of the driving devices 170 and 171.

The control board 115 may be installed in a horizontal state. The control board 115 may be installed so as to be spaced apart from the bottom of the nozzle base 110.

Therefore, even if water falls to the bottom of the nozzle base 110, water can be prevented from contacting the control board 115. The nozzle base 110 may be provided with a support protrusion 120*a* for supporting the control board 115 away from the bottom.

The board installation portion 120 may be positioned at one side of the flow path forming portion 150 in the nozzle base 110, although not limited thereto. For example, the control board 115 may be disposed at a position adjacent to the adjusting unit 180.

Accordingly, the structure for connection of the control board 115 and the variable resistor 292 may be simplified.

The nozzle base 110 may further include supporting ribs 122 for supporting the lower sides of each of the driving devices 170 and 171 and fastening bosses 117 and 117*a* for fastening each of the driving devices 170 and 171.

The nozzle base 110 may further include a nozzle hole 119, through which each of the spray nozzles 149 may pass.

A portion of the spray nozzle 149 coupled to the nozzle cover 130 may pass through the nozzle hole 119 when the nozzle cover 130 is coupled to the nozzle base 110.

In addition, the nozzle base 110 may further include a hole 118 for preventing interference with the structures of each of the driving devices 170 and 171, and a fastening boss 121 for fastening the flow path forming portion 150.

Driving Device

Figure 14:
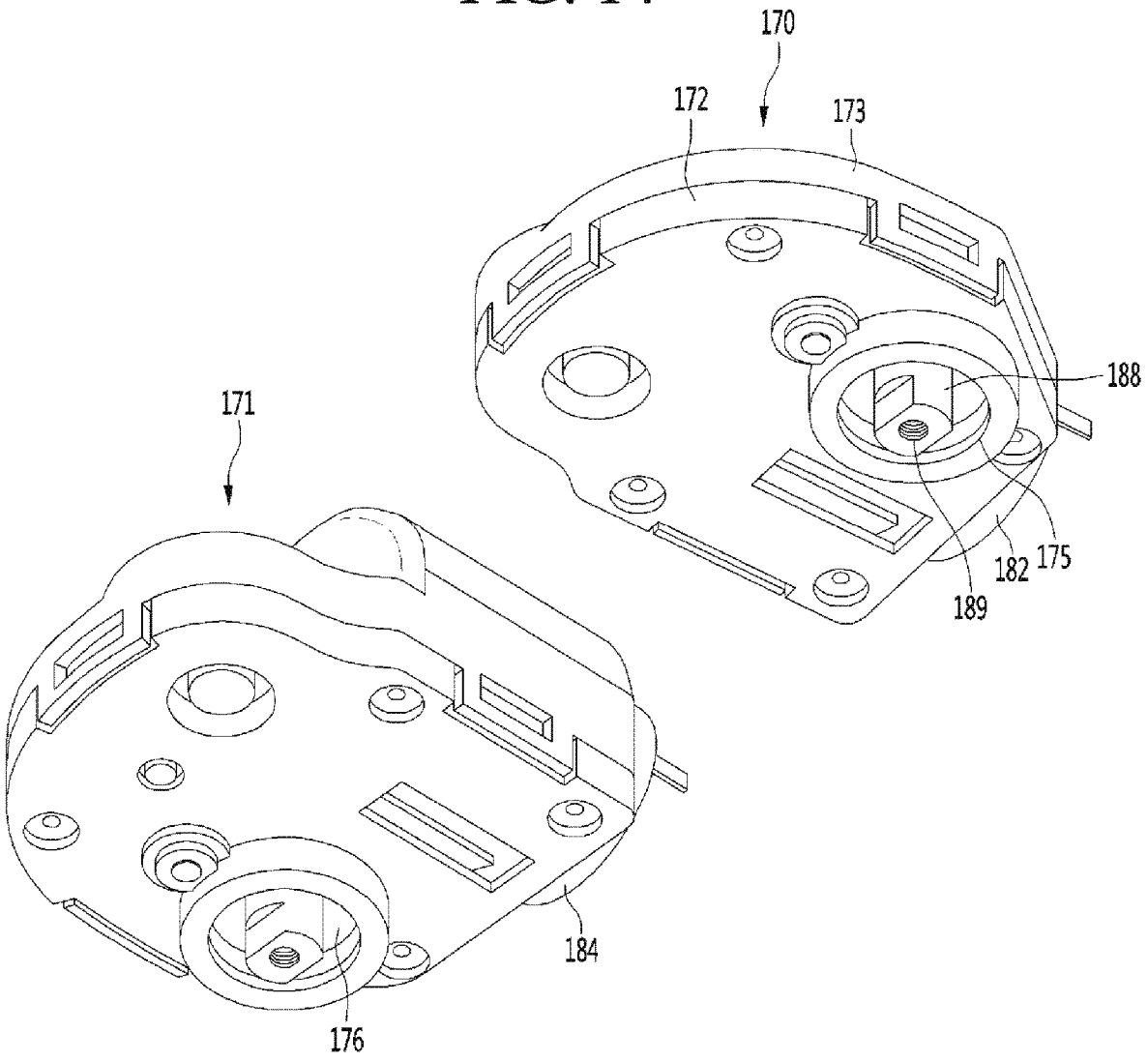
FIG. 14 is a perspective view of first and second driving devices according to an embodiment of the present disclosure.

FIG. 14 is a view illustrating the first and second driving devices according to one embodiment of the present disclosure.

Referring to FIG. 14, the first driving device 170 and the second driving device 171 may be formed and disposed symmetrically in the lateral direction.

The first driving device 170 may include a first driving motor 182 and the second driving device 171 may include a second driving motor 184.

Each of the driving devices 170 and 171 may further include a motor housing. The driving motors 182 and 184 and a power transmission unit for transmitting power can be received in the motor housing.

The motor housing may include, for example, a first housing 172, and a second housing 173 coupled to the upper side of the first housing 172.

The axis of each of the driving motors 182 and 184 may substantially extend in the horizontal direction in a state where each of the driving motors 182 and 184 is installed in the motor housing.

The first housing 172 may have a shaft hole 175 through which the transmission shaft 190 for coupling with the rotation plates 420 and 440 of the power transmission unit may pass. For example, a portion of the transmission shaft 188 may protrude downward through the lower side of the motor housing.

The horizontal section of the transmission shaft 190 may be formed in a non-circular shape such that relative rotation of the transmission shaft 190 may be prevented when the transmission shaft 188 is coupled with the rotation plates 420 and 440.

A sleeve 174 may be provided around the shaft hole 175 in the first housing 172. The sleeve 174 may protrude from the lower surfaces of the first housing 172. A bearing 176, to which the transmission shaft 188, is coupled may be disposed in the area where the sleeve 174 is formed.

Rotation Plate

Figure 16:
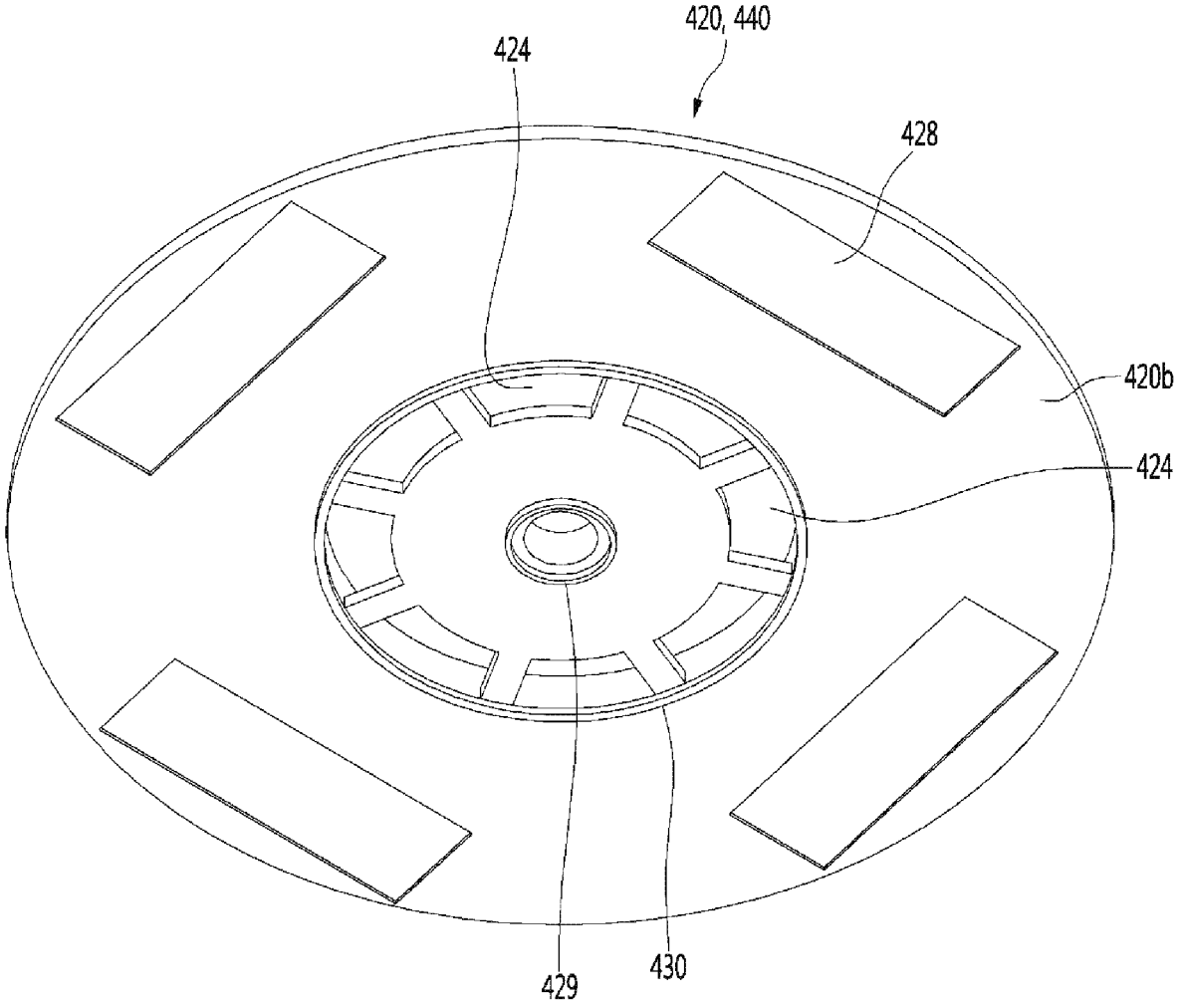
FIG. 16 is a view showing the rotary plate viewed from the bottom according to an embodiment of the present disclosure.

FIG. 15 is a view illustrating a rotation plate according to an embodiment of the present disclosure as viewed from above, and FIG. 16 is a view illustrating a rotation plate according to an embodiment of the present disclosure as viewed from below.

Referring to FIG. 15 and FIG. 16, a shaft coupling unit 421 for coupling the transmission shaft 188 may be provided at a central portion of each of the rotation plates 420 and 440.

For example, the transmission shaft 188 may be inserted into the shaft coupling unit 421. For this purpose, a shaft receiving groove 422 for inserting the transmission shaft 190 may be formed in the shaft coupling unit 421.

A fastening member may be drawn into the shaft coupling unit 421 from below the rotation plates 420 and 440 and may be fastened to the transmission shaft 188 when the transmission shaft 188 is coupled to the shaft coupling unit 421.

The rotation plates 420 and 440 may include a plurality of water passage holes 424 disposed outwardly of the shaft coupling unit 421 in the radial direction.

In the present embodiment, since the rotation plates 420 and 440 are rotated in a state where the mops 402 and 404 are attached to the lower sides of the rotation plates 420 and 440, so as to smoothly supply water to the mops 402 and 404 through the rotation plates 420 and 440, the plurality of water passage holes 424 may be spaced circumferentially around the shaft coupling unit 421.

The plurality of water passage holes 424 may be defined by a plurality of ribs 425. At this time, each of the ribs 425 may be positioned lower than the upper surface 420*a* of the rotation plates 420 and 440.

Since the rotation plates 420 and 440 may rotate, centrifugal force may act on the rotation plates 420 and 440. It may be necessary to prevent the water sprayed to the rotation plates 420 and 440 from flowing radially outward in a state where the water cannot pass through the water passage holes 424 in the rotation plates 420 and 440 due to the centrifugal force.

Therefore, a water blocking rib 426 may be formed on the upper surface 420*a* of the rotation plates 420 and 440 radially outside of the water passage hole 424. The water blocking ribs 426 may be formed continuously in the circumferential direction. The plurality of water passage holes 424 may be positioned in the inner region of the water blocking ribs 426.

An installation groove 428 may be formed on the lower surface 420*b* of the rotation plates 420 and 440 to provide attachment means for attaching the mops 402 and 404. The attachment means can be, for example, a Velcro.

A plurality of installation grooves 428 may be spaced apart in the circumferential direction with respect to the rotation centers C1 and C2 of the rotation plates 420 and 440. Therefore, a plurality of attachment means may be provided on the lower surface 420*b* of the rotation plates 420 and 440.

In the present embodiment, the installation groove 428 may be disposed radially outward of the water passage hole 424 with respect to the rotation centers C1 and C2 of the rotation plates 420 and 440.

For example, the water passage hole 424 and the installation groove 428 may be sequentially arranged radially outward from the rotation centers C1 and C2 of the rotation plates 420 and 440.

The contact ribs 430 may protrude downward from a lower surface 420*b* of the rotation plates 420 and 440.

The contact ribs 430 may protrude downward from a lower surface 420*b* of the rotation plates 420 and 440.

The contact ribs 430 may be disposed radially outward of the water passage holes 424 and may be formed continuously in the circumferential direction.

Since the mops 402 and 404 can be deformed by itself, for example, as a fiber material, gaps can exist between the mops 402 and 404 and the lower surfaces 420*b* of the rotation plates 420 and 440 when the mops 402 and 404 are attached to the rotation plates 420 and 440 by the attaching means.

When the gap existing between the mops 402 and 404 and the lower surfaces 420*b* of the rotation plates 420 and 440 is large, water may not be absorbed in the mops 402 and 404 while passing through the water passage hole 424 and may flow to the outside through the gap between the lower surfaces 420*b* of the rotation plates 420 and 440 and the upper surface of the mops 402 and 404.

However, according to the present embodiment, when the mops 402 and 404 are coupled to the rotation plates 420 and 440, the contact ribs 430 can be brought into contact with the mops 402 and 404, the nozzle 1 may be placed on the floor, and the contact rib 430 may press the mops 402, 404 by the load of the nozzle 1.

Accordingly, the contact ribs 430 may prevent the formation of the gap between the lower surfaces 420*d* of the rotation plates 420 and 440 and the upper surfaces of the mops 402 and 404, and thus, water passing through the water passage holes 424 can be smoothly supplied to the mops 402 and 404.

Guide ribs 429 for guiding attachment of the mops 402 and 404 may be disposed on the bottom of the rotation plates 420 and 440. The guide ribs 429, for example, may be formed in ring shapes and may protrude downward from the bottom of the rotation plates 420 and 440.

Mop

Figure 17:
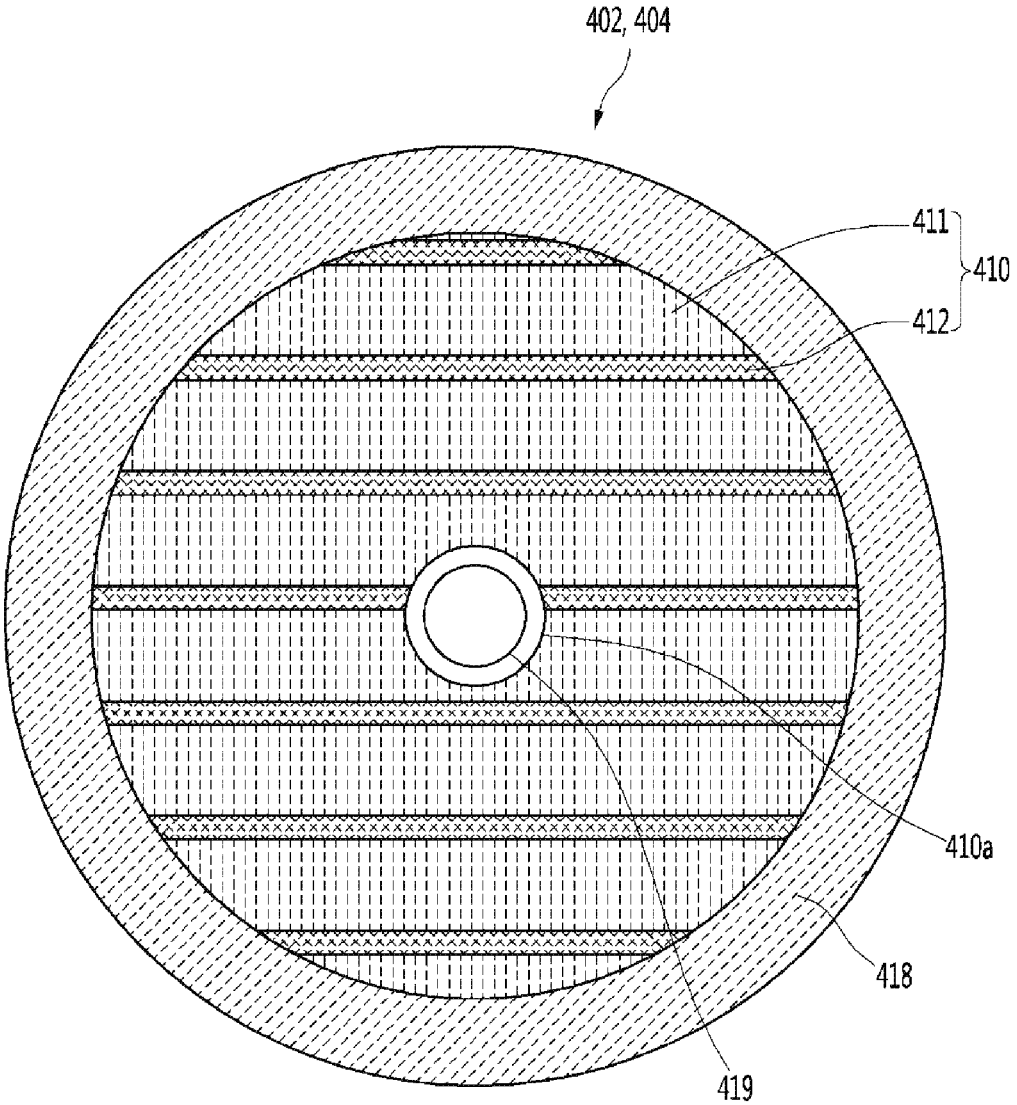
FIG. 17 is a bottom view of a mop according to an embodiment of the present disclosure.
Figure 18:
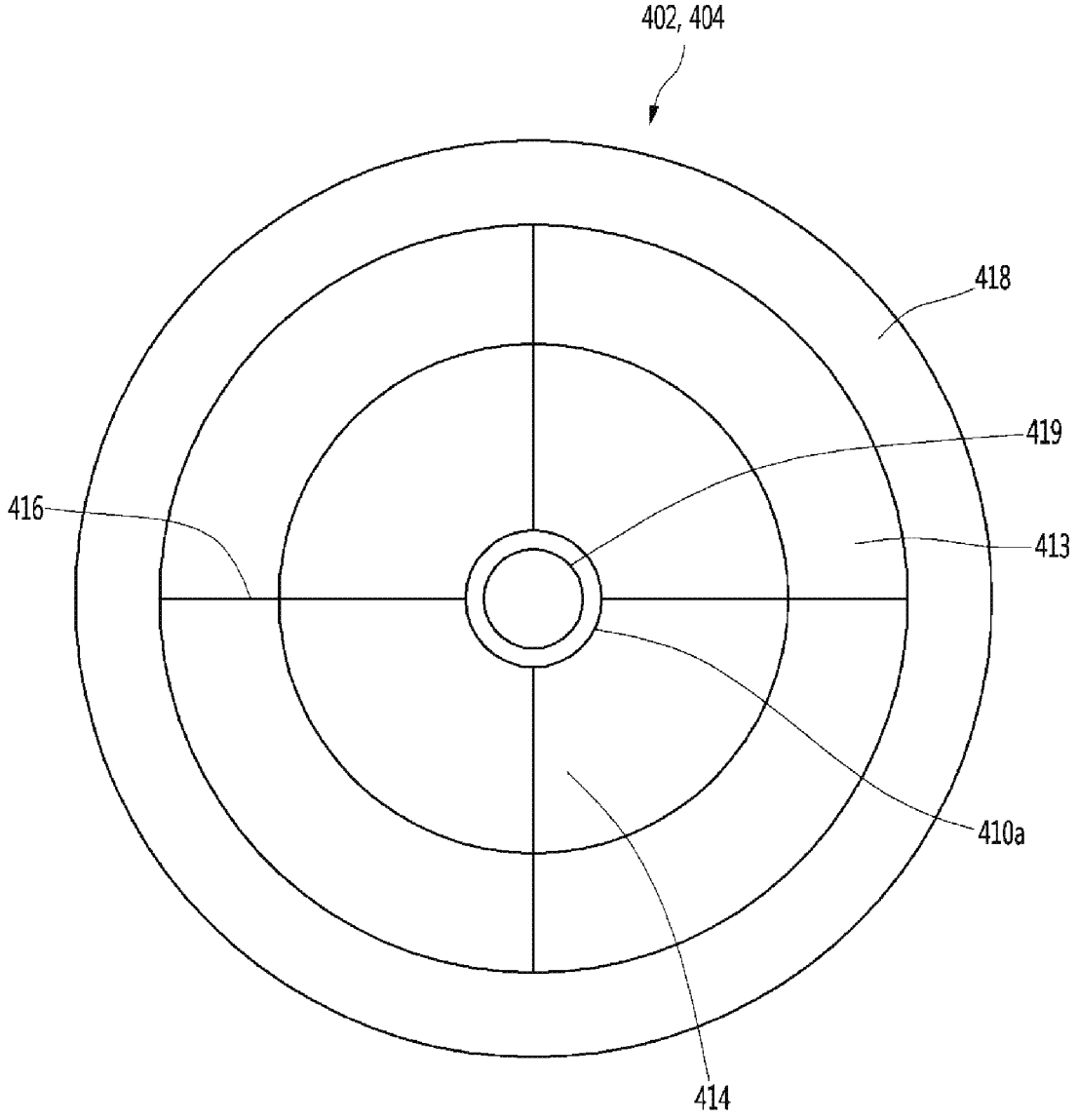
FIG. 18 is a plan view of the mop according to an embodiment of the present disclosure.
Figure 19:
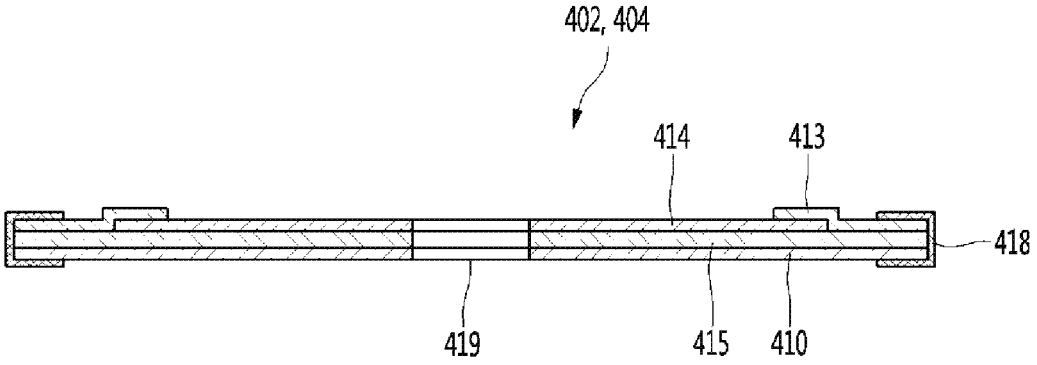
FIG. 19 is a vertical cross-sectional view of the mop according to an embodiment of the present disclosure.

FIG. 17 is a bottom view of a mop according to an embodiment of the present disclosure, FIG. 18 is a plan view of the mop according to an embodiment of the present disclosure, and FIG. 19 is a vertical cross-sectional view of the mop according to an embodiment of the present disclosure. A cut line of a mop passes the center of the mop in FIG. 19.

Referring to FIGS. 17 and 18, the mops 402 and 404 according to an embodiment of the present disclosure may include a floor cleaning portion 410 that cleans a floor in contact with the floor.

The floor cleaning portion 410, for example, may be formed in a disc shape.

The floor cleaning portion 410 may include a first section 411 that absorbs water and a second section 412 that allows the floor cleaning portion 410 smoothly slide on a floor.

In the present embodiment, the first section 411 and the second section 412 may be formed straight and may be alternately arranged. Alternatively, one or more of the first section 411 and the second section 412 may be disposed in a curved shape.

For example, the first section 411 and the second section 412 may be formed in ring shapes and may be alternately arranged.

The thickness of the threads of the first section 411 may be smaller than the thickness of the threads of the second section 412.

The first section 411, for example, may be fabricated using microfibers. The length of the hairs of the first section 411 is not limited, but may be about 3 mm.

The second section 412, for example, may be fabricated using polyester (PET). The length of the hairs of the second section 412 is also not limited, but may be about 3 mm.

The entire area of the first section 411 may be larger than the entire area of the second section 412 in the floor cleaning portion 410. For example, the ratio of the area of the first section 411 to the area of the floor cleaning portion 410 may be 75% or more.

The width of the first section 411 may be larger than the width of the second section 412.

The mops 402 and 404 may further include a water absorbing portion 415 disposed over the floor cleaning portion 410.

The water absorbing portion 415 may also be formed in a disc shape. The water absorbing portion 415 may not only absorb and provide water to the floor cleaning portion 410, but may also maintain the shape of the mops 402 and 404.

The thickness of the water absorbing portion 415 may be larger than the thickness of the floor cleaning portion 410. Though not limited, the thickness of the water absorbing portion 415 may be 5 mm.

The water absorbing portion 415, for example, may be made of polyurethane (PU). The water absorbing portion 415 can be attached to the floor cleaning portion 410 by heating the water absorbing portion 415.

The mops 402 and 404 may further include an attaching portion that is attached to the rotation plates 420 and 440.

The attaching portion 413, for example, may be formed in a ring shape and may be disposed over the water absorbing portion 415. The attaching portion 413 may be attached to the Velcro on the bottom of the rotation plates 420 and 440. A portion of the attaching portion 413 may be in contact with the top of the water absorbing portion 415.

The mops 402 and 404 may further include an upper absorbing portion 414 that absorbs water. The upper absorbing portion 414 may be formed in a disc shape and may be disposed over the water absorbing portion 415.

The outer diameter of the water absorbing portion 415 may be larger than the inner diameter of the attaching portion 413. Accordingly, the outer edge of the water absorbing portion 415 may vertically overlap the inner edge of the attaching portion 413.

The outer diameter of the upper absorbing portion 414 may be larger than the inner diameter of the attaching portion 413. Accordingly, the outer edge of the upper absorbing portion 414 may vertically overlap the inner edge of the attaching portion 413. For example, at least a portion of the attaching portion 413 may be positioned over the upper absorbing portion 414. A portion of the attaching portion 413 may be in contact with the top of the upper absorbing portion 414.

Accordingly, the water absorbing portion 415 and the attaching portion 413 may be sewn in a state where they overlap each other. The upper absorbing portion 414 and the attaching portion 413 may be sewn in a state where they overlap each other.

The upper absorbing portion 414, for example, may be fabricated using microfibers. The upper absorbing portion 414 may be made of the same material as at least a portion of the floor cleaning portion 410. For example, the upper absorbing portion 414 may be made of the same material as the first section 411 of the floor cleaning portion 410.

The upper absorbing portion 414 may be made of a mixture of polyester and nylon of at a ratio of about 8:2.

The mops 402 and 404 may further include an edge sewn portion 418 coupled to surround the floor cleaning portion 410, the water absorbing portion 415, and the attaching portion 413.

The edge sewn portion 418 may be fabricated using microfibers and may have hairs having a length of about 1 mm so that the floor cleaning portion 410 can come in contact with a floor.

The mops 402 and 404 may have a center opening 419 so that the centers of the mops 402 and 404 can be aligned with the centers of the rotation plates 420 and 440 when the mops 402 and 404 are attached to the rotation plates 420 and 440.

The center opening 419 may be formed through the upper absorbing portion 414, the water absorbing portion 415, and the floor cleaning portion 410. That is, the upper absorbing portion 414, the water absorbing portion 415, and the floor cleaning portion 410 may each include an opening and these openings may form the center opening 419.

The surrounding of the center opening 419 may be finished by overlocking. An overlocked portion **410*a* may exist along the circumference of the center opening 419**.

A user can attach the mops 402 and 404 to the rotation plates 420 and 440 such that the center openings 419 are aligned with the guide ribs 429 of the rotation plates 420 and 440.

A plurality of sewing lines 416 may be formed in a cross shape at the mops 402 and 404 such that the center openings 419 and the guide ribs 429 of the rotation plates 420 and 440 can be easily aligned.

The crossing centers of the plurality of sewing lines may be positioned at the center openings 419. For example, the crossing centers of the plurality of sewing lines may be aligned with the centers of the center openings 419.

Accordingly, a user can hold a portion of the mops 402 and 404 with respect to the sewing lines 416 and then align the center openings 419 with the guide ribs 429 of the rotation plates 420 and 440. That is, the sewing lines 416 may serve assistance such that the center openings 419 and the shaft coupling units 421 of the rotation plates 420 and 440 can be easily aligned.

The diameters of the guide ribs 429 may be smaller than the diameters of the center openings 419, so that when the mops 402 and 404 are attached to the rotation plates 420 and 440, they may be positioned at the center openings 419.

Disposition of Driving Device

Figure 20:
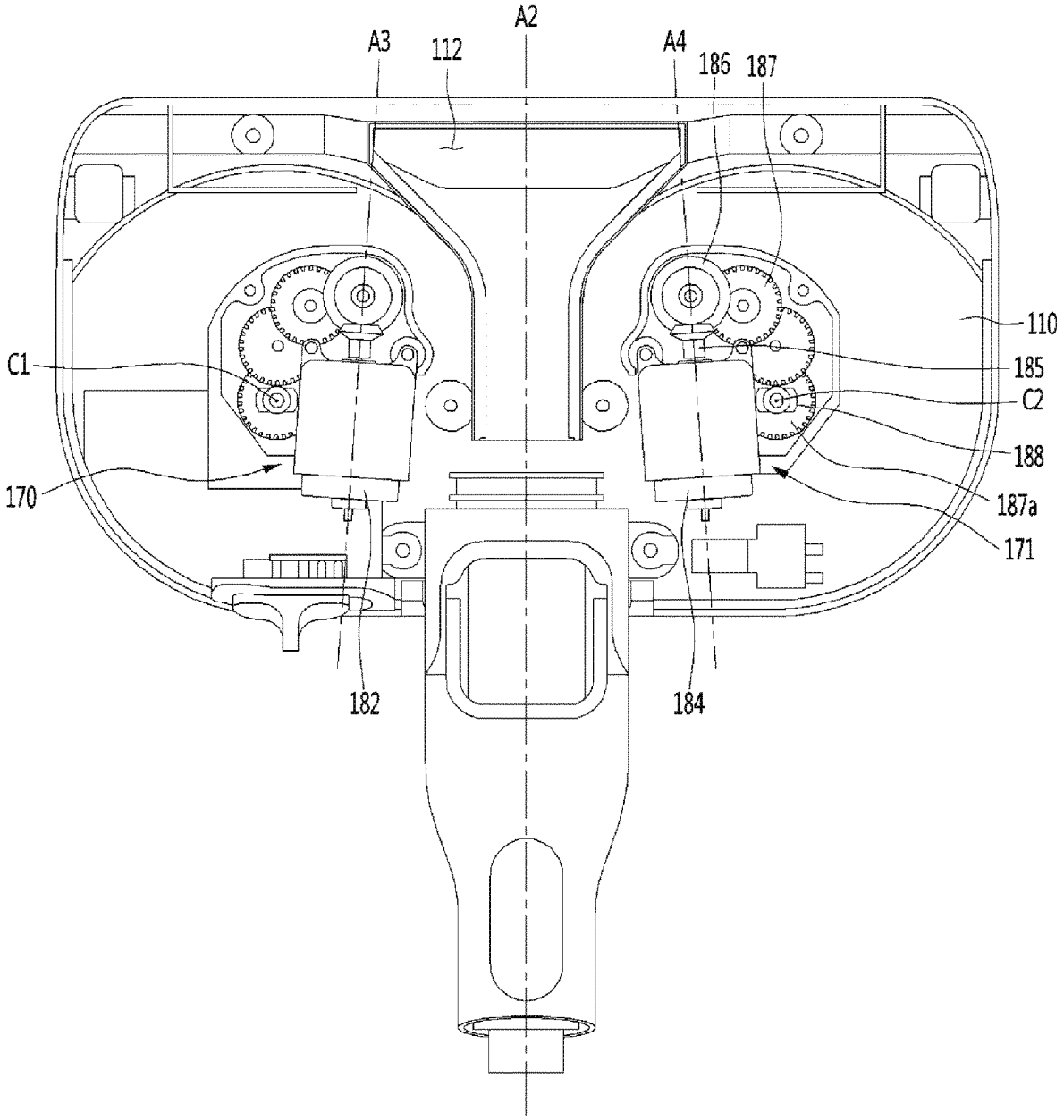
FIG. 20 is a plan view showing a state when a driving device is installed on the nozzle base according to an embodiment of the present disclosure.

FIG. 20 is a plan view illustrating a state where a driving device is installed on a nozzle base according to an embodiment of the present disclosure, and FIG. 21 is a front view illustrating a state where a driving device is installed on a nozzle base according to an embodiment of the present disclosure.

Particularly, FIG. 20 illustrates a state where the second housing of the motor housing is removed.

Referring to FIGS. 20 and 21, as described above, the driving devices 170 and 171 may be spaced apart from each other at left and right on the nozzle base 110.

The center line A2 of the second flow path may be positioned between the first driving device 170 and the second driving device 171.

Though not limited, the axis A3 of the first driving motor 182 and the axis A4 of the second driving motor 184 may extend forward and rearward.

The axis A3 of the first driving motor 182 and the axis A4 of the second driving motor 184 may be disposed in parallel to each other or to make a predetermined angle.

In the present embodiment, a virtual line A5 connecting the axis A3 of the first driving motor 182 and the axis A4 of the second driving motor 184 may pass through the second flow path 114. This is because the driving motors 182 and 184 may be disposed close to the rear of the nozzle, so an increase in height of the nozzle 1 due to the driving motors 182 and 184 may be prevented.

The power transmission unit may include a driving gear 185 connected to the shafts of the driving motors 182 and 184, and a plurality of transmission gears 187 that transmits torque of the driving gear 185.

The axes A3 and A4 of the driving motors 182 and 184 may extend horizontally, but the rotational center lines of the rotation plates 420 and 440 may extend vertically. Accordingly, the driving gear 185, for example, may be a bevel gear.

The transmission shaft 188 may be connected to the final gear 187*a* of the plurality of transmission gears 187.

In order to minimize an increase in height of the nozzle 1 due to the driving devices 170 and 171, the driving gear 185 may be positioned between the driving motors 182 and 184 and the first flow path 112 with the driving gear 185 connected to the shafts of the driving motors 182 and 184.

In this case, the driving motors 182 and 184 having the largest vertical length of the driving device 170 and 171 may be positioned close to the rear in the nozzle main body 10, so an increase in height at the front end of the nozzle 1 can be minimized.

In the present embodiment, the rotational centers C1 and c2 of the rotation plates 420 and 440 may be aligned with the rotational center of the transmission shaft 188.

The axes A3 and A4 of the driving motors 182 and 184 may be positioned in the area between the rotational centers C1 and c2 of the rotation plates 420 and 440.

Further, the driving motors 182 and 184 may be positioned in the area between the rotational centers C1 and c2 of the rotation plates 420 and 440.

Further, the driving motors 182 and 184 may be disposed such that they vertically overlap the virtual line connecting the first rotational center C1 and the second rotational center C2.

Water Supply Flow Path

Figure 23:
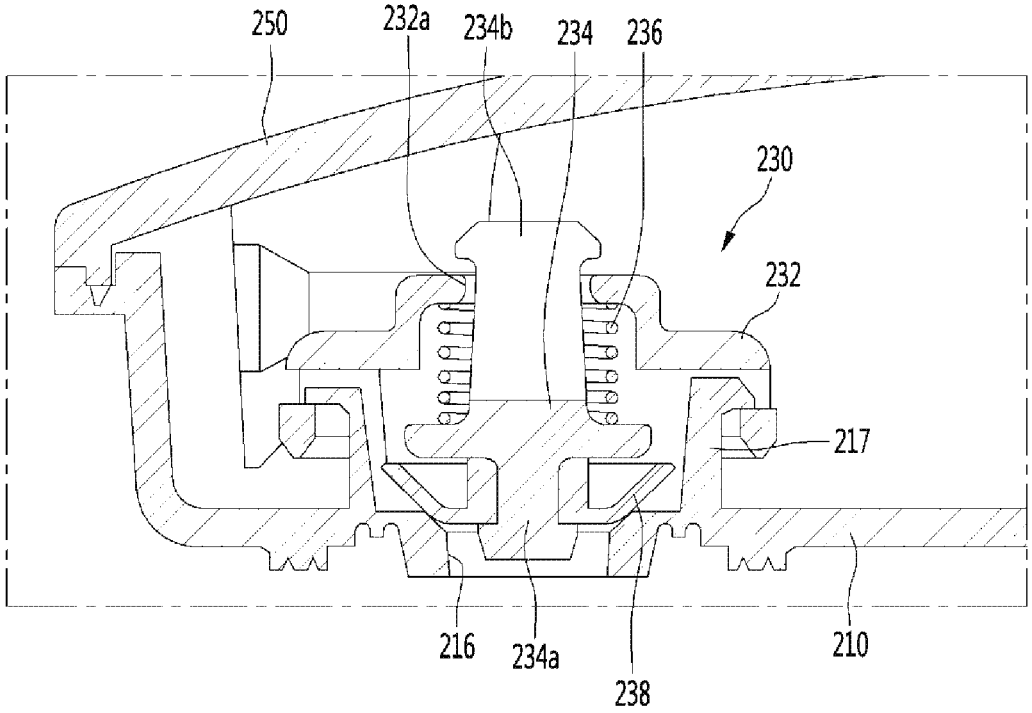
FIG. 23 is a view showing a valve in the water tank according to an embodiment of the preset disclosure.
Figure 24:
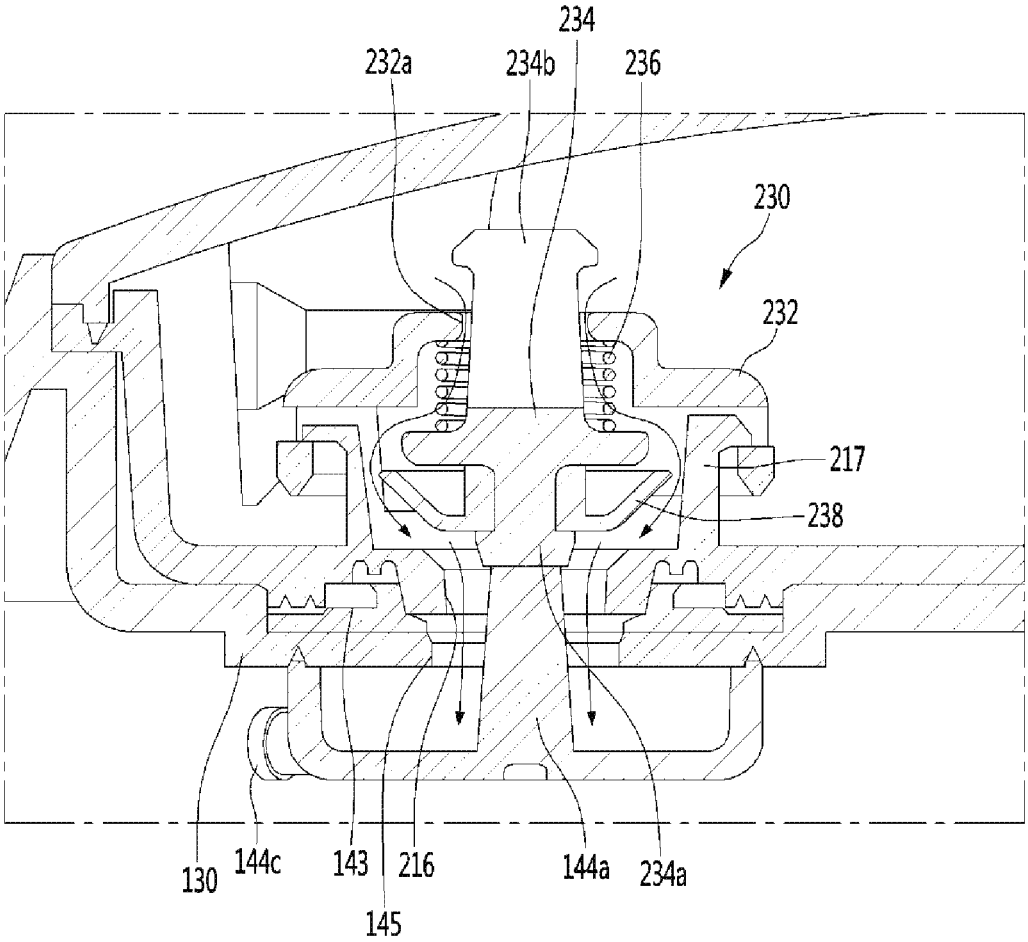
FIG. 24 is a view showing a state when an outlet is opened by the valve with the water tank mounted on a nozzle housing according to an embodiment of the present disclosure.

FIG. 22 is a view illustrating a water supply flow path for supplying water of a water tank to the rotation cleaning unit according to an embodiment of the present disclosure, FIG. 23 is a view illustrating a valve in a water tank according to an embodiment of the present disclosure, and FIG. 24 is a view illustrating a state where the valve opens the discharge port in a state where the water tank is mounted on the nozzle housing.

Figure 25:
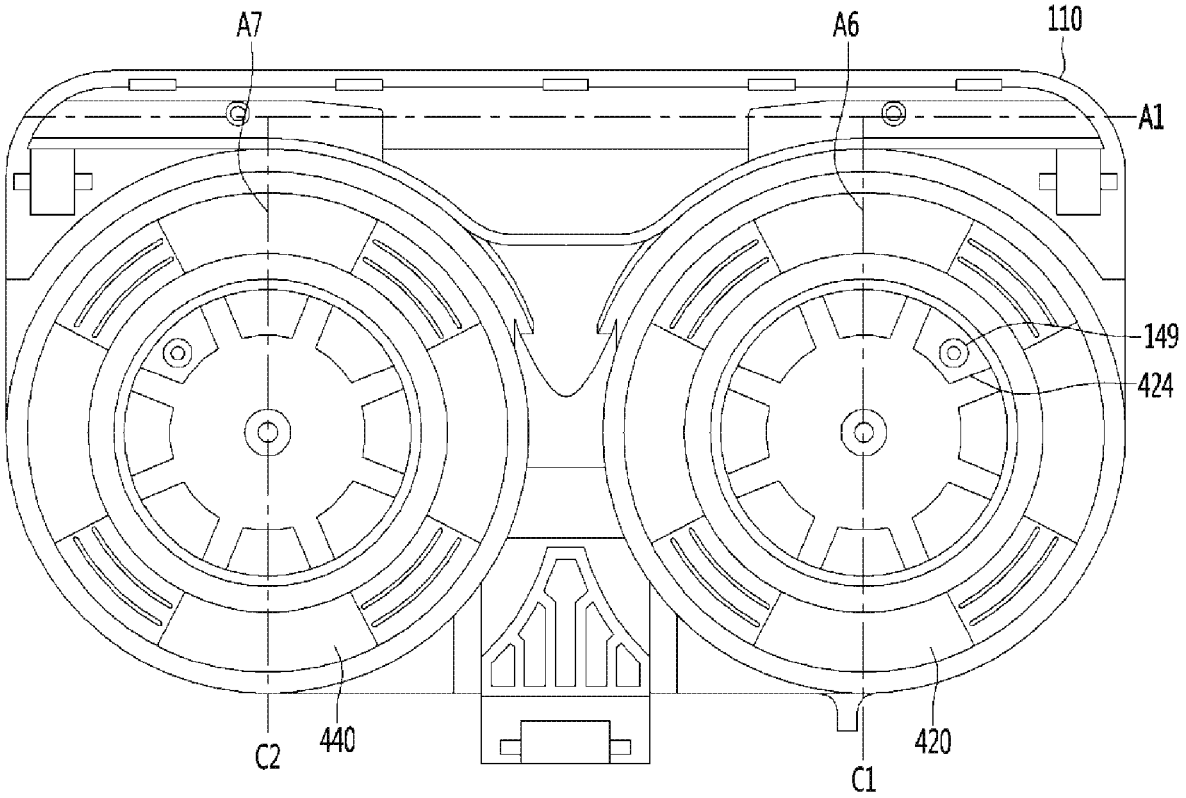
FIG. 25 is a view showing a state when the rotary plate is combined with the nozzle body according to an embodiment of the present disclosure.
Figure 26:
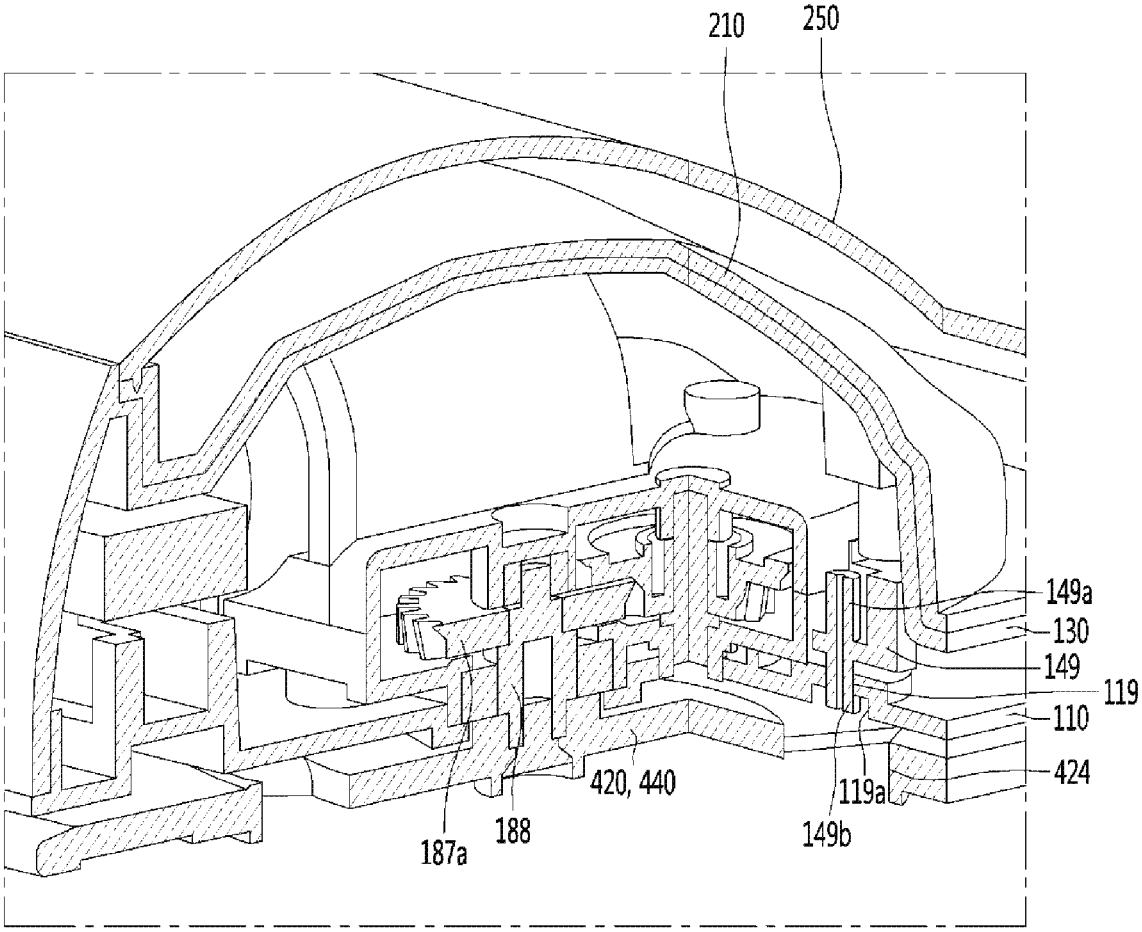
FIG. 26 is a view showing arrangement of a spray nozzle on a nozzle body according to an embodiment of the present disclosure.

FIG. 25 is a view illustrating a rotation plate connected to a nozzle main body according to an embodiment of the present disclosure, and FIG. 26 is a view illustrating a disposition of a spray nozzle in a nozzle main body according to an embodiment of the present disclosure.

Figure 27:
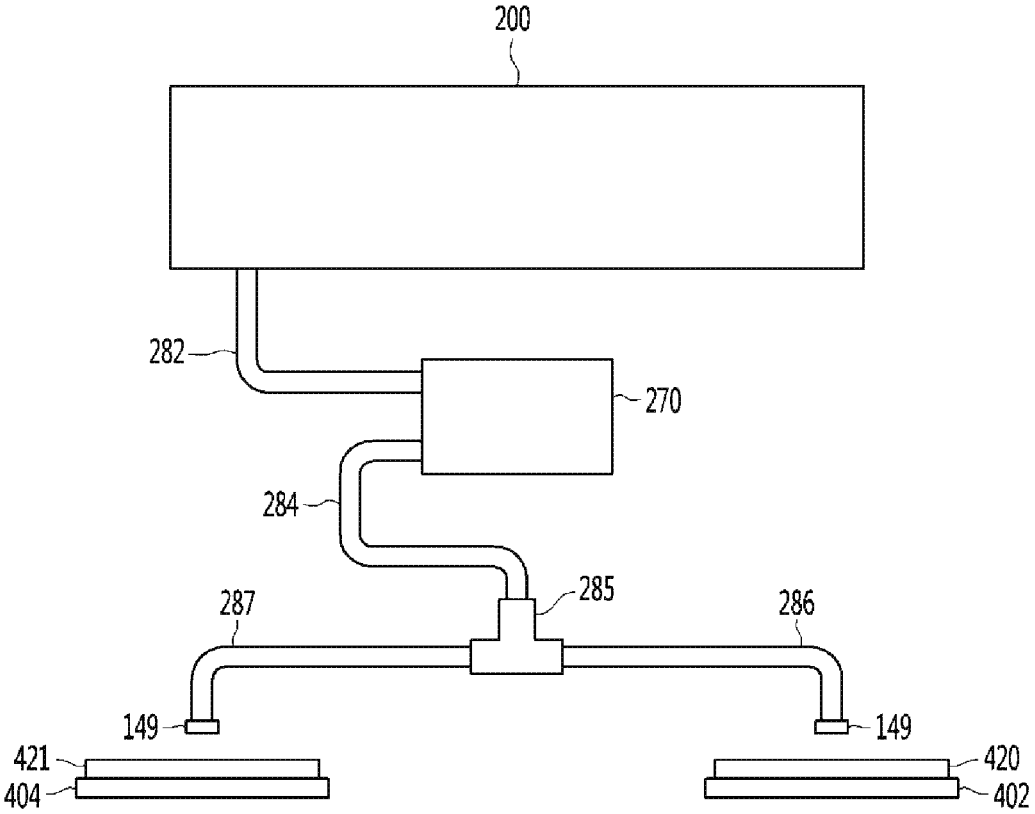
FIG. 27 is a conceptual view showing a process of supplying water from a water tank to a rotary cleaning unit according to an embodiment of the present disclosure.

FIG. 27 is a conceptual diagram illustrating a process of supplying water to a rotation cleaning unit in a water tank according to an embodiment of the present disclosure.

Referring to FIG. 22 to FIG. 27, the water supply flow path of the present embodiment includes a first supply tube 282 connected to the valve operating unit 144, a water pump 270 connected to the first supply tube 282, and a second supply tube 284 connected to the water pump 270.

The water pump 270 may include a first connection port 272 to which the first supply tube 282 is connected and a second connection port 274 to which the second supply tube 284 is connected. On the basis of the water pump 270, the first connection port 272 may be an inlet, and the second connection port 274 may be a discharge port.

The water supply flow path may further include a connector 285 to which the second supply tube 284 is connected.

The connector 285 may be formed such that the first connection unit 285*a*, the second connection unit 285*b*, and the third connection unit 285*c* are arranged in a T-shape. The second connection tube 284 may be connected to the first connection unit 285*a*.

The water supply flow path may further include a first branch tube 286 connected to the second connection unit 285*b* and a second branch tube 287 connected to the third connection unit 285*b*.

Accordingly, the water flowing through the first branch tube 286 may be supplied to the first rotation cleaning unit 40 and may be supplied to the second rotation cleaning unit 41 flowing through the second branch tube 287.

The connector 285 may be positioned at the central portion of the nozzle main body 10 such that each of the branch tubes 286 and 287 has the same length.

For example, the connector 285 may be positioned below the flow path cover 136 and above the flow path forming portion 150. Thus, substantially the same amount of water can be dispensed from the connector 285 to each of the branch tubes 286 and 287.

In the present embodiment, the water pump 270 may be positioned at one point on the water supply flow path.

At this time, the water pump 270 may be positioned between the valve operating unit 144 and the first connection unit 285*a* of the connector 285 so that water can be discharged from the water tank 200 using a minimum number of the water pumps 270.

In the present embodiment, the water pump 270 may be installed in the nozzle cover 130 in a state where the water pump 270 is positioned close to the portion where the valve operating unit 144 is installed.

As an example, the valve operating unit 144 and the water pump 270 may be provided on one side of both sides of the nozzle main body 10 with respect to the centerline A2 of the second flow path 114.

Therefore, the length of the first supply tube 282 can be reduced, and accordingly, the length of the water supply flow path can be reduced.

Each of the branch tubes 286 and 287 may be connected to the spray nozzle 149. The spray nozzle 149 can also form the water supply flow path of the present disclosure.

The spray nozzle 149 may include a connection unit 149*a* to be connected to each of the branch tubes 286 and 287 as described above.

The spray nozzle 149 may further include a water discharge port 149*b*. The water discharge port 149*b* may extend downward through the nozzle hole 119. In other words, the water discharge port 149*b* may be disposed on the outside of the nozzle housing 100.

When the water discharge port 149*b* is positioned outside the nozzle housing 100, water sprayed through the water discharge port 149*b* can be prevented from being drawn into the nozzle housing 100.

At this time, so as to prevent the water discharge port 149*b* exposed to the outside of the nozzle housing 100 from being damaged, grooves 119*a* recessed upward may be formed in the bottom of the nozzle base 110, and the water discharge port 149*b* may be positioned in the groove 119*a* in a state of passing through the nozzle hole 119. In other words, the nozzle hole 119 may be formed in the groove 119*a*.

The water discharge port 149*b* may be disposed to face the rotation plates 420 and 440 in the groove 119*a*.

The water sprayed from the water discharge port 149*b* can pass through the water passage hole 424 of the rotation plates 420 and 440.

A line perpendicularly connecting the first rotation center C1 and the centerline A1 of the first flow path 112 may be referred to as a first connection line A6, and a line perpendicularly connecting the second rotation center C2 and an axis A1 of the first flow path 112 may be referred to as a second connecting line A.

At this time, the first connection line A6 and the second connection line A7 may be positioned in a region between a pair of water discharge port 149*b* for supplying water to each of the rotation cleaning units 40 and 41.

This is because parts constituting the driving devices 170 and 171 may exist in the area between the first connection line A6 and the second connection line A7, so the spray nozzle 419 may be disposed such that interference with the parts is prevented.

The horizontal distance between water discharge port 149*b* and the centerline A1 of the first flow path 112 may be shorter than the horizontal distance between each of the rotation centers C1 and C2 and the centerline A1 of the first flow path 112.

Meanwhile, the valve 230 may include a movable unit 234, an opening and closing unit 238, and a fixing unit 232.

The fixing unit 232 may be fixed to a fixing rib 217 protruding upward from the first body 210 of the water tank 200.

The fixing unit 232 may have an opening 232*a* through which the movable unit 234 passes.

The fixing unit 232 may restrict the movable unit 234 from moving upward at a predetermined height from the fixing unit 232 in a state where the fixing unit 232 is coupled with the fixing rib 217.

The movable unit 234 can be moved in the vertical direction in a state where a portion of the movable unit 234 passes through the opening 232*a*. In a state where the movable unit 234 is moved upward, water can pass through the opening 232*a*.

The movable unit 234 may include a first extension portion 234*a* extending downward and coupled with the opening and closing unit 238 and a second extension portion 234*b* extending upwardly and passing through the opening 232*a*.

The movable unit 234 may be elastically supported by an elastic member 236. One end of the elastic member 263, such as a coil spring, for example, may be supported by the fixed portion 232 and the other end may be supported by the movable unit 234.

The elastic member 236 may provide a force to the movable unit 234 to move the movable unit 234 downward.

The opening/closing unit 238 can selectively open the discharge port 216 by moving the movable unit 234 up and down.

At least a portion of the opening/closing unit 238 may have a diameter larger than the diameter of the discharge port 216 so that the opening/closing unit 238 may block the discharge port 216.

The opening/closing unit 238 may be formed of, for example, a rubber material so that the leakage of water may be prevented in a state where the opening/closing unit 238 blocks the discharge port 216.

The elastic force of the elastic member 236 may be applied to the movable unit 234 so that a state where the opening and closing unit 238 blocks the discharge port 216 can be maintained unless an external force is applied to the movable unit 234.

The movable unit 234 can be moved by the valve operating unit 144 in the process of mounting the water tank 200 to the nozzle main body 10.

The valve operating unit 144 may be coupled to the nozzle cover 130 from below the nozzle cover 130 as described above. A water through-hole 145, through which the water discharged from the water tank 200, may be formed at the nozzle cover 130.

The valve operating unit 144 may include a pressing portion 144*a* passing through the water through-hole 145. The pressing portion 144*a* may protrude upward from the bottom of the nozzle cover 130 through the water through-hole 145 of the nozzle cover 130.

The valve operating unit 144 may form a water supply flow path together with the bottom of the nozzle cover 130. A connection tube 144*c* for connecting the first supply tube 282 may be provided at one side of the valve operating unit 144.

The diameter of the water passage hole 145 may be larger than the outer diameter of the pressing portion 144*a* so that water may flow smoothly in a state where the pressing portion 144*a* passes through the water passage hole 145.

When the water tank 200 is mounted on the nozzle main body 10, the pressing portion 144*a* may be drawn into the discharge port 216 of the water tank 200. The pressing portion 144*a* may press the movable unit 234 in a process in which the pressing portion 144*a* is being drawn into the discharge port 216 of the water tank 200.

The movable unit 234 may be lifted and the opening and closing unit 238 coupled to the movable unit 234 may move upward together with the movable unit 234 to be separated from the discharge port 216, to thereby open the discharge port 216.

The water in the water tank 200 may be discharged through the discharge port 216 and then may flow through the valve operating unit 144 by the water passage hole 145. The water may be supplied to the first supply tube 282 connected to the connection tube 144*c*.

The water supplied to the first supply tube 282 may flow into the second supply tube 284 after being drawn into the water pump 270. The water flowing into the second supply tube 284 may flow to the first branch tube 286 and the second branch tube 287 by the connector 285. The water flowing into each of the branch tubes 286 and 287 may be sprayed from the spray nozzle 149 toward the rotation cleaning units 40 and 41.

The water sprayed from the spray nozzle 149 may be supplied to the mops 402 and 404 after passing through the water passage holes 424 of the rotation plates 420 and 440. The mops 402 and 404 may be rotated while absorbing the supplied water to wipe the floor.

According to the embodiments of the present disclosure, not only may an inlet be provided that can suction foreign substances on a floor, but mops may also be provided that can wipe the floor by rotating the rotation plates to which the mops are attached, so the floor cleaning performance can be improved.

Further, since the water tank can be attached to the nozzle and supply water to the mops, there is an advantage that convenience for a user may be increased.

Further, according to the present embodiment, since a flow path extends forward and rearward at the center portion of the nozzle and the driving devices for rotating rotation cleaning portions are disposed at both sides of the flow path, an increase in length of an air flow path for flow or air is prevented, so an increase in loss of flow path can be prevented.

Further, according to the present embodiment, since a plurality of rotation members to which mops are attached are independently driven by a plurality of motors, there is an advantage in that even if some of the plurality of motors are broken, cleaning can be performed by the others.

Further, since the water tank is disposed to surround the driving unit cover that covers the driving devices, the amount of water that can be stored in the water tank can be increased and an increase in height of the entire nozzle can be prevented.

Further, since the mops include not only the floor cleaning portion that can absorb water, but also the upper absorbing portion, the amount of water in the mops may increase, so the floor cleaning performance using the mops can be improved.

Further, according to the present embodiment, since the first section that enables the floor cleaning portion of the mop to absorb water and the second section that enables easy sliding are provided, there is an advantage in that the mops may easily move on a floor.

Further, according to the present embodiment, since the openings are formed at the centers of the mops, there is an advantage in that it is possible to attach the mops to the rotation plates such that the centers of the mops and the rotation plates are aligned.

What is claimed is:

1. A mop, comprising:

a floor cleaning portion defining a bottom surface of the mop;

an upper absorbing portion configured to receive water supplied from a water tank to supply the water to the floor cleaning portion; and an attaching portion positioned along an outer circumference of the upper absorbing portion, and defining top surface of the mop with the upper absorbing portion, wherein, in the top surface of the mop, the upper absorbing portion is formed in a disc, the disc being exposed upward to receive the water supplied from the water tank, wherein, in the top surface of the mop, the attaching portion is formed to have an arc, the arc being disposed to surround the disc in a radial direction and being exposed upward, and wherein, in the top surface of the mop, an outer diameter of the arc is larger than an outer diameter of the disc.

2. The mop of claim 1, further comprising a center opening formed through a center of the floor cleaning portion and a center of the upper absorbing portion.

3. The mop of claim 1, further comprising a plurality of sewing lines disposed on the mop, the plurality of sewing lines crossing each other in cross shapes, and wherein crossing centers of the plurality of sewing lines are positioned at a center portion of the mop.

4. The mop of claim 1, wherein:

the attaching portion is ring-shaped, and an outer diameter of the upper absorbing portion is larger than an inner diameter of the attaching portion such that a portion of the upper absorbing portion and a portion of the attaching portion overlap each other in a vertical direction.

5. The mop of claim 4, wherein a portion of the attaching portion is positioned over the upper absorbing portion.

6. The mop of claim 1, wherein the upper absorbing portion and at least a portion of the floor cleaning portion are made of a same material.

7. The mop of claim 1, wherein:

the floor cleaning portion comprises a first section comprising threads and a second section comprising threads that are thicker than the threads of the first section.

8. The mop of claim 7, wherein:

the first section and the second section are formed in at least one of a straight shape or a curved shape, and the first section and the second section are alternately arranged.

9. The mop of claim 1, further comprising a water absorbing portion positioned between the upper absorbing portion and the floor cleaning portion.

10. The mop of claim 9, wherein a portion of the attaching portion is in contact with the water absorbing portion and another portion of the attaching portion is in contact with the upper absorbing portion.

11. A cleaner, comprising:

a housing;

a rotation cleaning unit rotatably disposed under the housing, the rotation cleaning unit having the mop of claim 1 for cleaning a floor and a rotation plate coupled to the mop;

a driving device disposed in the housing and having a motor configured to drive the rotation cleaning unit; and wherein the water tank is mounted on the housing and is configured to store water to be supplied to the rotation cleaning unit.

12. The mop of claim 1, wherein at least a portion of the upper absorbing portion is positioned radially inward than the attaching portion, and wherein at least a portion of the attaching portion is positioned radially outward than the upper absorbing portion.

13. The mop of claim 1, wherein an outer edge of the upper absorbing portion is configured to vertically overlap an inner edge of the attaching portion and be sewn with the attaching portion.

14. The cleaner of claim 11, wherein the rotation plate is provided with attachment means for attaching the mops on a lower surface of the rotation plate.

15. The cleaner of claim 14, further comprising a water discharge port provided on a bottom wall of the housing and discharging the water of the water tank to an outside of the housing, and wherein the water discharge port is located over the upper absorbing portion.

16. The cleaner of claim 15, wherein the attachment means are disposed radially outward than the water discharge port based on a rotation center of the rotation plate.

17. The cleaner of claim 15, wherein the rotation plate includes a water passage hole through which water discharged from the water discharge port passes.

18. The cleaner of claim 17, wherein the water passage hole is disposed radially inward than the attaching portion based on a rotation center of the rotation plate.

19. The cleaner of claim 17, wherein the rotation plate further includes a contact rib disposed on the lower surface of the rotation plate and formed to protrude downward, and wherein the contact rib is disposed radially outward than the water passage hole based on the rotation center of the rotation plate.

20. The cleaner of claim 19, wherein the contact rib is disposed radially inward than the attaching portion based on the rotation center of the rotation plate.

21. The cleaner of claim 15, wherein the attaching portion is disposed radially outward than the water discharge port based on a rotation center of the rotation plate.

22. The cleaner of claim 17, further comprising grooves formed in a lower portion of the housing, wherein the water discharge port is disposed to face the rotation plate in the grooves.

23. The cleaner of claim 11, further comprising a connection tube to which the housing is detachably connected, wherein the connection tube guides the air sucked into the housing into the cleaner.

24. The cleaner of claim 11, wherein the rotation plate includes a guide rib disposed on the rotation plate, the guide rib formed in a center portion of the rotation plate to align with an opening of the upper absorbing portion, and wherein the guide rib has a smaller diameter than the opening of the upper absorbing portion.

25. The cleaner of claim 11, wherein the rotation plate further includes an installation groove in which the mop is installed, and wherein the installation groove is detachably coupled to the attaching portion.

26. The cleaner of claim 25, wherein the installation groove is positioned to correspond with a region defined by the attaching portion so as to be attached to the attaching portion in a vertical direction and is located on a bottom surface of the rotation plate.

27. The mop of claim 1, further comprising an edge sewn portion surrounding a plurality of edges of the attaching portion and the floor cleaning portion.

28. The mop of claim 1, wherein the arc is positioned to have a common center with the disc.

29. The mop of claim 1, wherein the arc is formed to have a curvature corresponding to a curvature of the disc.

30. The mop of claim 1, wherein the arc is positioned radially spaced apart from a center of the disc.

* * * * *